US007171788B2

(12) United States Patent
Bronner

(10) Patent No.: US 7,171,788 B2
(45) Date of Patent: Feb. 6, 2007

(54) MASONRY CONNECTORS AND TWIST-ON HOOK AND METHOD

(76) Inventor: Joseph Bronner, 36 Copeland Rd., Denville, NJ (US) 07834

( * ) Notice: Subject to any disclaimer, the term of this patent is extended or adjusted under 35 U.S.C. 154(b) by 87 days.

(21) Appl. No.: 10/401,071

(22) Filed: Mar. 27, 2003

(65) Prior Publication Data

US 2003/0188499 A1 Oct. 9, 2003

Related U.S. Application Data

(60) Provisional application No. 60/370,532, filed on Apr. 5, 2002, provisional application No. 60/374,896, filed on Apr. 23, 2002.

(51) Int. Cl.
*E04B 1/16* (2006.01)

(52) U.S. Cl. ..... 52/379; 52/513; 52/715; 52/747.12

(58) Field of Classification Search ..... 52/378, 52/379, 334, 698, 700, 712, 729.3, 513, 699, 52/354, 351, 38.3, 565, 562, 396.08, 715, 52/714, 713, 745.09, 747.12
See application file for complete search history.

(56) References Cited

U.S. PATENT DOCUMENTS

| | | | | | |
|---|---|---|---|---|---|
| 1,854,633 | A * | 4/1932 | Stephens | 52/215 |
| 1,924,724 | A * | 8/1933 | Olney | 52/379 |
| 2,240,117 | A * | 4/1941 | Homolya | 52/506.03 |
| 3,341,998 | A * | 9/1967 | Lucas | 52/379 |
| 3,587,198 | A * | 6/1971 | Hensel | 52/745.09 |
| 3,707,815 | A * | 1/1973 | Molyneux | 52/213 |
| 4,002,001 | A * | 1/1977 | Uydess | 52/731.5 |
| 4,107,890 | A * | 8/1978 | Seghezzi et al. | 52/379 |
| 4,473,984 | A | 10/1984 | Lopez | |
| 4,606,163 | A * | 8/1986 | Catani | 52/434 |
| 4,764,069 | A | 8/1988 | Reinwall et al. | |
| 4,869,038 | A * | 9/1989 | Catani | 52/410 |
| 4,955,172 | A * | 9/1990 | Pierson | 52/710 |
| 5,035,099 | A * | 7/1991 | Lapish | 52/713 |
| 5,347,781 | A * | 9/1994 | Hanlon | 52/379 |
| 5,392,581 | A * | 2/1995 | Hatzinikolas et al. | 52/712 |
| 5,456,052 | A * | 10/1995 | Anderson et al. | 52/713 |
| 5,816,008 | A * | 10/1998 | Hohmann | 52/565 |
| 6,128,883 | A * | 10/2000 | Hatzinikolas | 52/698 |
| 6,212,841 | B1 * | 4/2001 | Plume | 52/513 |
| 6,279,283 | B1 * | 8/2001 | Hohmann et al. | 52/379 |
| 6,332,300 | B1 * | 12/2001 | Wakai | 52/713 |
| 6,502,362 | B1 * | 1/2003 | Zambelli et al. | 52/698 |
| 6,508,447 | B1 * | 1/2003 | Catani et al. | 248/300 |
| 6,739,105 | B2 * | 5/2004 | Fleming | 52/513 |
| 6,851,239 | B1 * | 2/2005 | Hohmann et al. | 52/513 |

* cited by examiner

*Primary Examiner*—Naoko Slack
(74) *Attorney, Agent, or Firm*—Anthony G. Volini

(57) ABSTRACT

A connecting device for joining a wall to a building frame, or for joining walls, comprises a hook member. The frame can comprise steel beams, or also comprise a truss having an open web, and a slide rail attached to the truss' chords in a generally plumb orientation. Embodiments of the hook member substantially encircle one or more slide rails and thereby retain the rails. Other embodiments fit within a channel attached to solid steel webs, or concrete frames. The device's other end is positioned over a course of masonry units, and when embedded in mortar, the cells of the masonry units do not require grouting. Other connecting device embodiments comprise an anchor member securely joined to the member, the connecting device providing multiple points of attachment with the masonry, or multiple members joined to the anchor member. The connecting device can be used for new construction, and in renovations using currently existing steel and concrete frames.

18 Claims, 17 Drawing Sheets

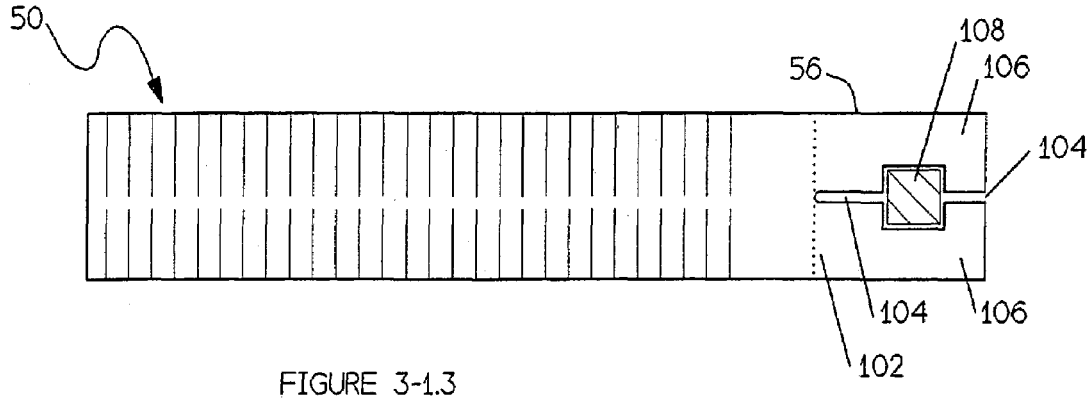
FIGURE 3-1.3
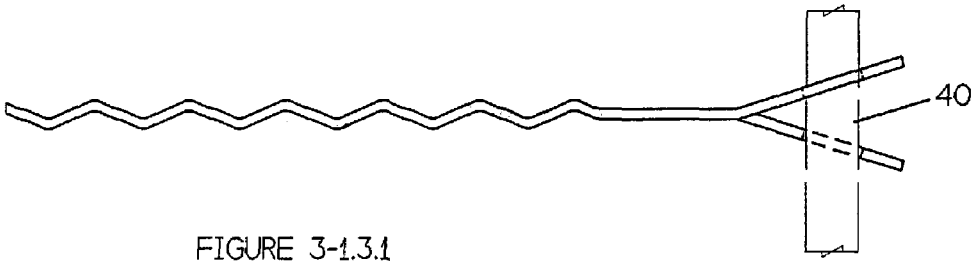
FIGURE 3-1.3.1
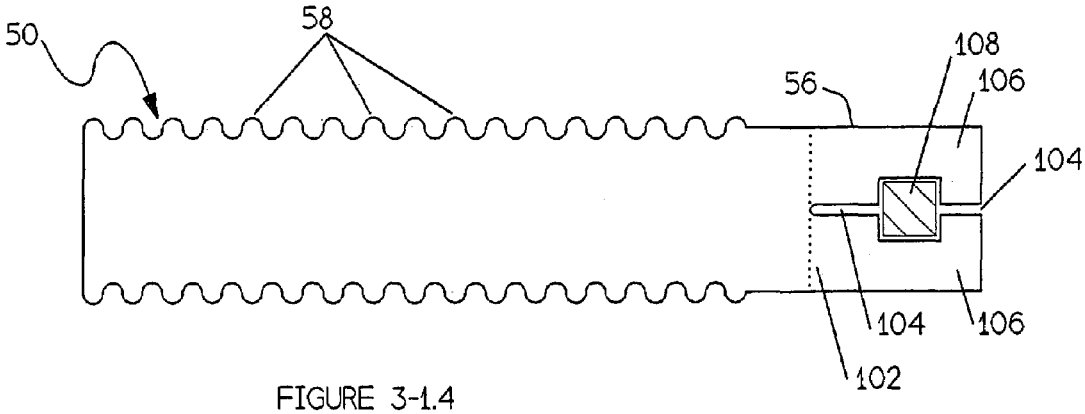
FIGURE 3-1.4
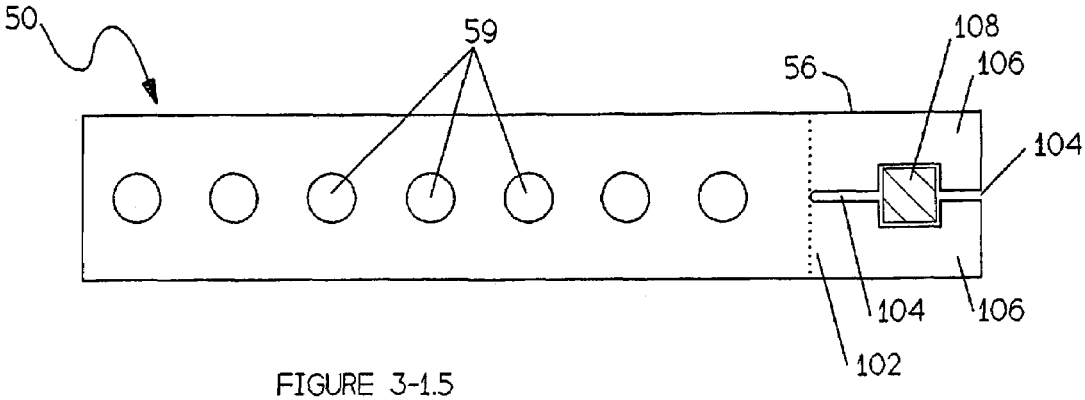
FIGURE 3-1.5

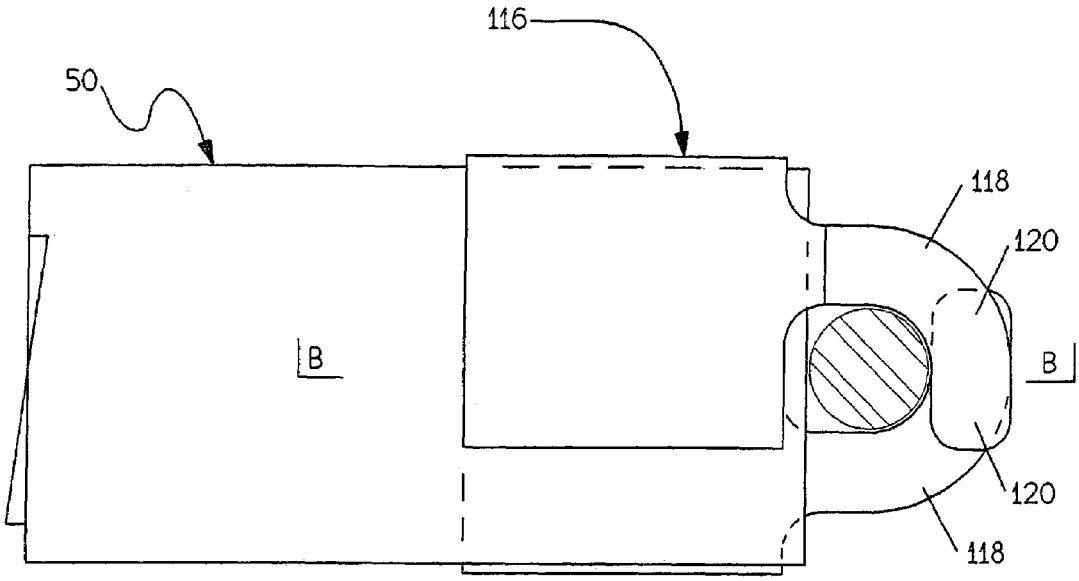
FIGURE 3-2
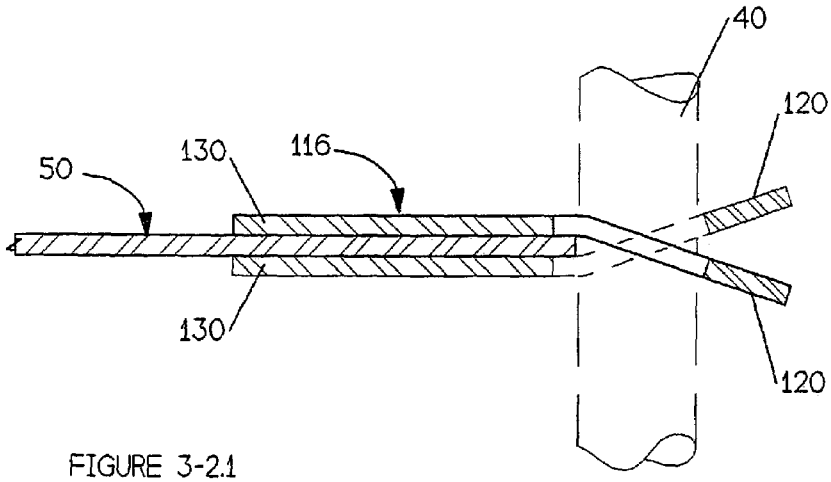
FIGURE 3-2.1

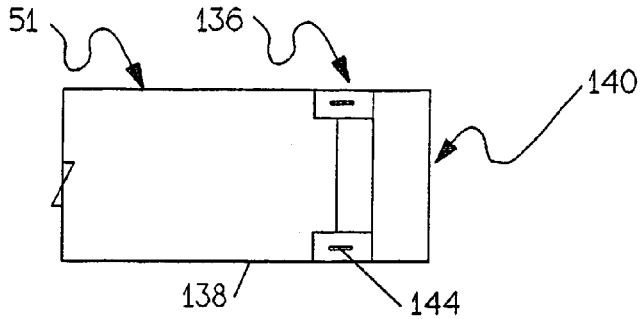
FIG. 3-3
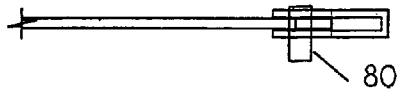
FIG. 3-3.1
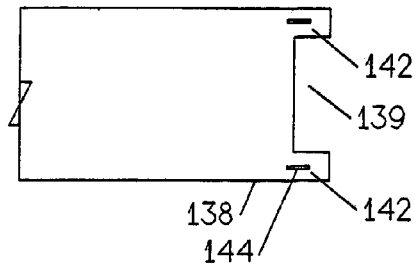
FIG. 3-3.2
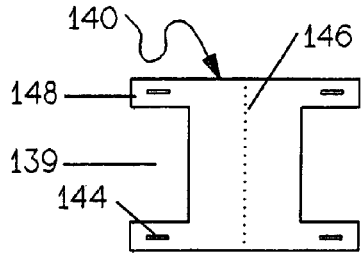
FIG. 3-3.3
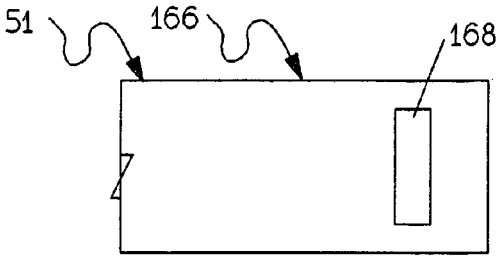
FIG. 3-4
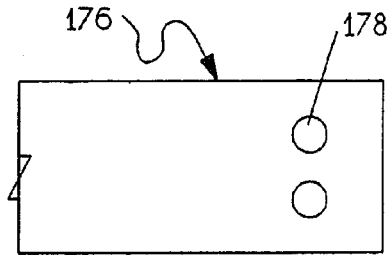
FIG. 3-5
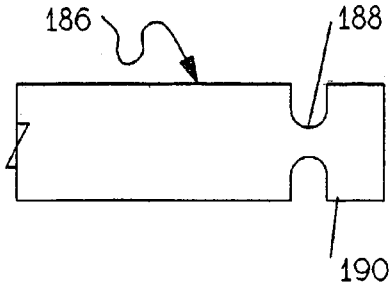
FIG. 3-6
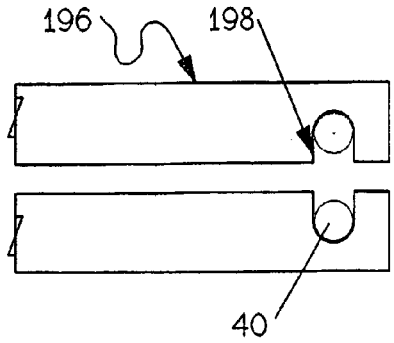
FIG. 3-7

MASONRY CONNECTORS AND TWIST-ON HOOK AND METHOD

CROSS-REFERENCES TO RELATED APPLICATIONS

This application claims the benefit of U.S. Provisional Patent Applications Ser. Nos.: 60/370,532, filed 5 Apr. 2002, and 60/374,896, filed 23 Apr. 2002, the contents of which are hereby incorporated by reference.

FIELD OF THE INVENTION.

The present invention relates to connecting the walls of a building to the frame of the building. Particularly it relates to a device for, and a method of, connecting a wall constructed from modular units, such as concrete masonry units ("cmu"), bricks, precast concrete elements or any other segments, to the building's frame. The frame can be made of steel, concrete, wood or other materials. The device and method can also be used to connect the walls to each other, for example, at intersections, between adjacent wythes and the like.

BACKGROUND OF THE INVENTION

Much of today's building construction consists of a building frame constructed of steel, concrete, or wood, and walls constructed of concrete masonry units, brick, precast concrete elements or any other segments mortared together.

For the purposes of this specification, the present invention will be described as being applicable to the attachment of walls prepared using concrete masonry units, which will also be referred to herein as masonry walls, to a steel frame building. However, it is to be understood that the device and method of the present invention are applicable to buildings having walls and frames constructed of other materials commonly used in the construction industry.

The role that the wall serves in a building is usually one or more of the following:

1. The wall can be a load bearing wall. In this case the wall is supporting part of the frame for gravity loads.
2. The wall can be a shear wall. In this case the wall provides resistance to the horizontal loads applied on the building, parallel to the direction of the wall.
3. The wall can be non-structural, such as when it is the outer skin of the building, or an interior wall.

In all of these roles, the wall itself may be supported for gravity loads by the foundation, or by the building's frame, or combinations thereof.

The present invention deals with the transfer of horizontal forces between the building frame and the walls. The causes for these forces are usually wind, seismic loads, soil pressure, and other factors known to those skilled in the art.

There are two types of horizontal forces transferred between the wall and the building frame:

1. Lateral forces perpendicular to the wall (transverse forces).
2. Longitudinal (shear) forces, parallel to the wall.

Generally, the wall is always connected to the frame so as to transfer the transverse forces between the wall and the building's frame. In the case when the wall is a shear wall, it is connected to the frame so as to transfer also the longitudinal shear forces between the wall and the building's frame.

Connectors, generally made of steel plate, are used to ensure the full transfer of horizontal forces between the masonry wall and the steel frame. The connectors are generally made of flat, or corrugated, but mostly galvanized, steel plate. The connectors are embedded in the masonry wall mortar beds on one end and hooked at their other end to a vertical sliding rail attached to the steel frame. The connectors are placed at frequent intervals, so as not to incur high secondary stress in the masonry wall or the steel frame. The present invention will deal with a device for, and method of, providing adequate steel connectors to transfer the applied horizontal forces.

The prior art provides basically two types of connectors:

1. A fixed length plate embedded in the masonry wall mortar bed, and/or embedded in fully grouted cells. The plate is hooked into a vertical slotted channel, the slotted channel generally being welded to the web of a steel beam which is parallel to the wall. The plate can be flat, corrugated and can have its embedded end hooked.
2. A fixed length plate embedded in the masonry wall mortar bed and/or embedded in fully grouted cells. The plate is hooked around the far edge of the beam or the truss flange. The plate can be flat, corrugated and can have its embedded end hooked.

The prior art connectors have several significant drawbacks:

1. The embedded part of the connector bar may end in the hollow cells of the masonry units. Thus, in order to provide adequate anchorage, the cells mut be fully grouted above and below the connector. The grouting is disruptive to the progress of wall construction, and is costly. The grouting operation requires additional quality control measures. If the grouting of the top cells is not done continuously with that of the bottom cells, the embedment will end up in what is known as a cold joint. The connector embedment is weakened by a cold joint because of the shrinkage of the separately poured portions of grout. As will be described later, the masonry connector system of the present invention corrects this condition by introducing an anchor bar member which is attached to a hook bar member. Thus, the connector will resist the applied forces in all situations, even when using a hollow masonry wall, using mortar only and without the need for grouting.
2. When the hook end of a prior art connector bar is "T-shaped to engage a slotted channel, it applies non-symmetrical forces on the channel, when in shear, which channel is not efficiently designed for such forces. In general, the prior art system is designed to resist very small forces, and the rail is designed to span a very short distance. The rail is typically a 5 or 6 inch long channel that is welded to the web of the beam. The present invention corrects this condition by providing a new connector bar hook end and a new sliding rail. The new system can economically resist bigger forces and span a longer distance, thus enabling the masonry connectors of the present invention to be attached to trusses as well as to beams, something the prior art did not provide for.
3. The prior art slotted channel is usually welded to the web of the beam. When connecting the wall to a sloped beam, the elevation of the slotted channel varies with the slope of the beam. The elevation of the connectors, which are embedded in the mortar bed between block courses, vary in steps corresponding to the block courses. Thus, in many cases, even if the short slotted channel accommodates the connector hook, it may not accommodate the additional clearance needed for the beam to deflect freely without bending the connector plate or introducing torsion in the beam. Many times the slot of the slotted channel falls against the solid wall of the cmu, not allowing the connector embedded in the mortar bed to be engaged. The masonry connector system of the present invention corrects this condition by introducing a new sliding rail that can be attached to the beam or joist so as to allow for a longer sliding length. It is not practical to install the slotted channel on an open web of a truss.

4. When the hook end of a prior art connector bar is "J" shaped, it hooks to the flange of a beam, truss or to any other steel member. This connection will be possible only if the flange of the steel member falls at the same elevation as the mortar bed of the masonry wall. This is mostly not the case, since even if designed for, the construction tolerances may cause such differences in those elevations. It is especially not the case when the steel member is sloped, as it is mostly in the roof. When successfully installed, this connection provides resistance to transverse force in one direction only. In addition, this does not allow the steel to deflect freely without bending the connector plate or introducing torsion in the steel. The masonry connector system of the present invention corrects this condition by introducing the same new method used for the beams (above), to be used in conjunction with the trusses, or other steel members where the vertical slotted channel cannot be attached.

Thus, there is a need to provide a new device for and method of connecting the masonry wall to the building steel. The present invention is designed to be more efficient, able to resist the actual loads applied on the building, and be consistent with the engineering concepts used in the structural design of the building. The present invention allows for attachment of walls to the building frame, using trusses as well as beams, which can produce a cost savings in the quantity of steel needed. The connecting devices embodied in the present invention allow for construction of masonry walls without the need for grouting between the cells.

BRIEF SUMMARY OF THE INVENTION

An object of the present invention is to provide a device for connecting a wall to the frame of a building.

Another object of the present invention is to provide a device having a variety of alternate ends for connecting a wall to the frame of a building.

Another object of the present invention is to provide a device for connecting a masonry wall to the frame of a building.

Still another object of the present invention is to provide a device whose position can be adjusted to different depths of embedment in the wall to compensate for differences in distance between the wall and the frame created by construction tolerances.

Yet another object of the present invention is to provide a device whose position can be adjusted to different depths of embedment in a masonry wall to compensate for differences in distance between the wall and the frame created by construction tolerances.

Yet another object of the present invention is to provide a device comprising a member which can be anchored in the wall at multiple points.

Still another object of the present invention is to provide a device comprising a member which can be anchored in the wall at various depths.

Yet another object of the present invention is to provide a device comprising a member which can maintain its embedment in a wall comprising hollow blocks, using mortar only and without the need to grout the cells.

Another object of the present invention is to provide a method for connecting a wall to the building frame.

Still another object of the present invention is to provide a method for connecting a masonry wall to the building frame.

Yet another object of the present invention is to provide a method for embedding a connector in a wall so that connector embedment remains efficient even as the depth of embedment varies to compensate for the construction tolerances, using mortar only, without the need for grout.

Still another object of the present invention is to provide a method for anchoring a connector in a wall at multiple points, such that the embedment is maintained even in hollow block wall, and even as the depth of embedment is varying, using mortar only without grouting the cells.

Another object of the present invention is to provide a connector device which is able to resist more efficiently forces perpendicular to the wall as well as forces that are parallel to the wall.

Another object of the present invention is to provide a connector device comprising a hook member that can engage a standard or special vertical sliding rail.

Another object of the present invention is to provide a hook member that can engage different types of rail.

Still another object of the present invention is to provide a hook member that can accommodate a sliding rail connection to columns and to trusses.

Another object of the present invention is to provide a method to attach a standard cross section sliding rail to new and existing steel, using welding, bolting or clamping.

Another object of the present invention is to provide a new hook member which can engage different types of rail, enabling a vertical sliding rail connection to beams, columns and trusses of the frame, whether new or previously existing.

In short, the instant invention deals with the elements of the connection detail between a masonry wall and the building frame.

The present invention comprises numerous embodiments of a masonry connector, which is used for joining a wall to a building frame, or for joining two walls. The walls can be made from a plurality of concrete masonry units which are disposed in courses, the concrete masonry units being joined by mortar. The frame can be a masonry frame, or a steel frame. The steel frame can comprise steel beams, or also comprise a truss having an open web, and a slide rail attached to the truss' chords in a generally plumb orientation. The masonry connector hook members embodiments include hooks, loops, apertures, twist tabs, or dovetailed tenons, which engage a slide rail or channel on the frame and substantially encircle the rail or channel. Additional embodiments of masonry connector include the addition of an anchor member securely joined to the first member, which may be joined to the first member such that the members pivot or do not pivot. These embodiments of masonry connector can form one of several configurations, such as an I, T, L or U-shape. The anchor member is embedded in mortar, and provides multiple points of contact between the masonry connector and the wall. Another embodiment comprises an anchor member joined to two identical hook members, enabling the masonry connector to connect a masonry wall directly to a column. These embodiments can be used for new construction, or for retrofitting a building during renovation. A method for using these masonry connector embodiments is also described.

BRIEF DESCRIPTION OF THE SEVERAL VIEWS OF THE DRAWINGS

FIG. 1-2 is an elevational view of a masonry wall connected to a steel beam that is parallel to the wall, using an embodiment of the masonry connector.

FIG. 1-3 is an elevational view of a masonry wall connected to a steel beam or truss connected to a vertical sliding rail, using an embodiment of the masonry connector.

FIG. 1-4 is an elevational view of a masonry wall connected to a truss, and with the sliding rail fastened to the center of the truss.

FIG. 1-5 is an elevational view of a masonry wall connected to a concrete wall or frame that is parallel to the masonry wall, with the sliding rail being embedded in the concrete.

FIG. 1-6 is an elevational view of a truss to which an embodiment of a sliding rail has been attached.

FIG. 1-7 is an elevational view of a truss to which a pair of sliding rails have been attached.

FIG. 2-1 is a top plan view of a masonry wall in which an I-type masonry connector embodiment has been embedded. This embodiment includes a slotted square hook configuration to fit a sliding rail.

FIG. 2-2 is a top plan view of a masonry wall with a "T Connector" embodiment of the masonry connector shown in FIG. 2-1 disposed thereon.

FIG. 2-3 is a top plan view of a masonry wall with an "L Connector" embodiment of the masonry connector shown in FIG. 2-1 disposed thereon.

FIG. 3-1 is a top plan view of the masonry connector with Twist-On Hook ("I-type") embodiment shown in FIG. 2-1.

FIG. 3-1.1 is a side view of the embodiment shown in FIG. 3-1. The connectors can be made from corrugated, serrated, perforated or dimpled galvanized steel, and may or may cont be stiffened with lateral corrugation, such as shown in FIGS. 3-1.2 and 3-1.2.1.

FIG. 3-1.2 is an elevational view of a reinforced hook bar, with the reinforcing elements shown in phantom.

FIG. 3-1.2.1 is a partial cross-sectional view taken along line A-A of FIG. 3-1.2.

FIG. 3-1.3 is a top plan view of an embodiment of the masonry connector illustrating the use of corrugated material.

FIG. 3-1.3.1 is a cross-sectional view of the embodiment of the masonry connector shown in FIG. 3-1.3.

FIG. 3-1.4 is a top plan view of an embodiment of the masonry connector illustrating the use of serrated material.

FIG. 3-1.5 is a top plan view of an embodiment of the masonry connector illustrating the use of perforated material.

FIG. 3-2 is a top plan view of a "Twist-On Hook" embodiment of the masonry connector, engaging a sliding rail.

FIG. 3-2.1 is a cross-sectional view of the "Twist-on Hook" member, taken along line B-B of FIG. 3-2.

FIG. 3-3 is a top plan view of another embodiment of the masonry connector, comprising a receiving member and a closing member.

FIG. 3-3.1 is a side view of the embodiment Illustrated in FIG. 3-3.

FIG. 3-3.2 is a top plan view of the receiving member of the embodiment illustrated in FIG. 3-11.

FIG. 3-3.3 is a top plan view of the closing member of the embodiment illustrated in FIG. 3-1.1.

FIG. 3-4 is a top plan view of a slotted embodiment of the masonry connector hook member.

FIG. 3-5 is a top plan view of an embodiment of the masonry connector hook member comprising multiple openings.

FIG. 3-6 is a top plan view of another embodiment of the masonry connector hook member comprising "T-type" hook to engage a double rail shown in FIG. 1-7.

FIG. 3-7 is a top plan view illustrating the use of multiple, notched embodiments, of the masonry connector hook member for receiving sliding rails.

FIG. 3-8 is a top plan view of another embodiment of the masonry connector hook member, with one example of a shaped end. This is an example of a conventional masonry connector.

FIG. 3-9 is a top plan view of a another embodiment of the masonry connector hook member, with one example of a dovetailed tenon. This is an example of a conventional masonry connector.

FIG. 4-1 is a top plan view of two masonry walls connected to each other, using an embodiment of the masonry connector.

FIG. 4-2 is a top plan view of a masonry wall connected to a column using another embodiment of the masonry connector.

FIG. 4-3 is a top plan view of a masonry wall connected to a steel column, using another embodiment of the masonry connector.

DETAILED DESCRIPTION OF THE INVENTION

Introduction

Figure 1:
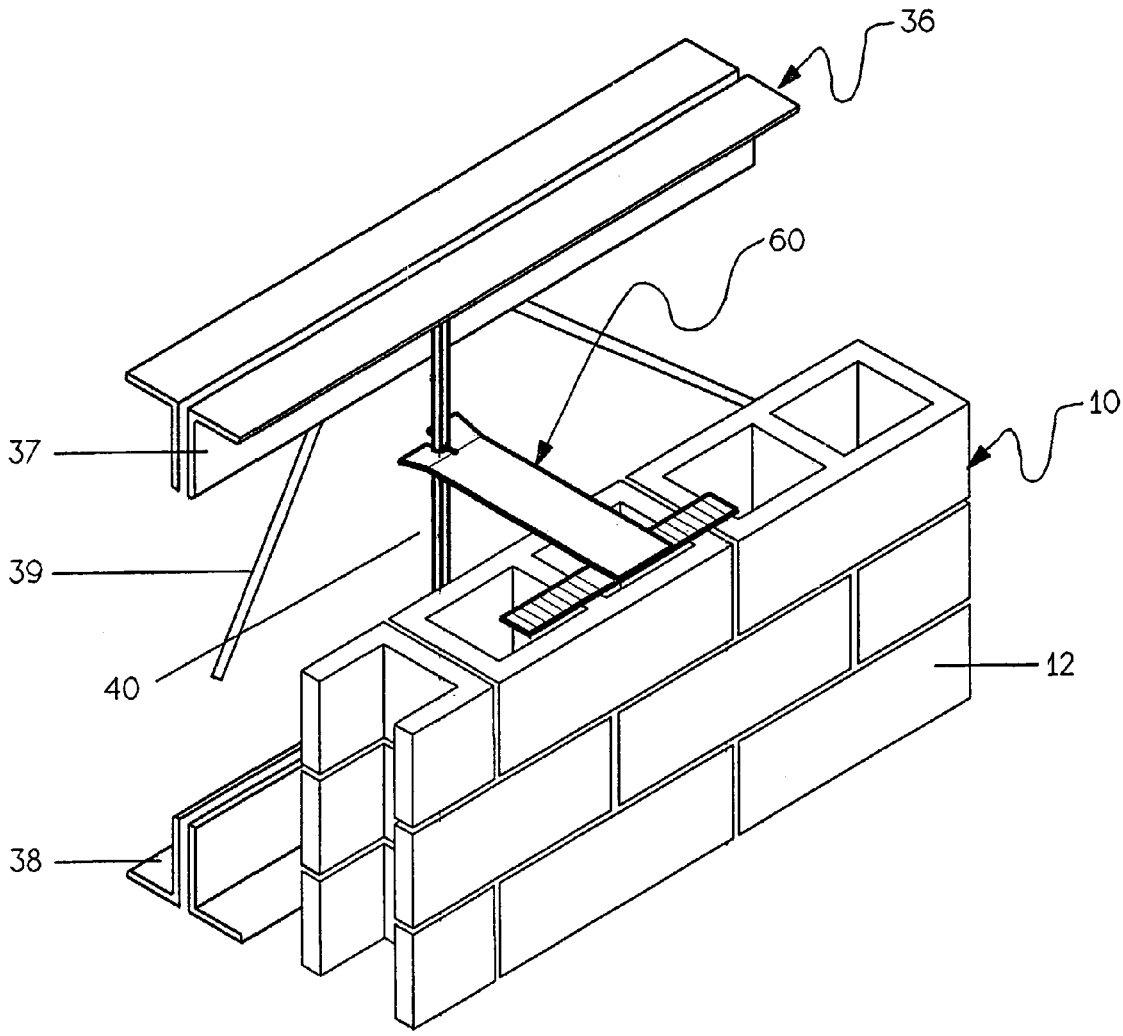
FIG. 1-1 is an isometric view of a masonry wall connected to a frame comprising a truss, using one embodiment ("T-Connector") of the masonry connector of the present invention.

The present invention comprises several embodiments of a device for, and method of, connecting a wall of a building to the frame of a building. The present invention may also be used as a system for connecting a wall of a building to the frame. The wall is constructed from modular units, such as concrete masonry units, bricks, precast concrete elements or any other segments. The frame can be made of steel, concrete, wood or other commonly used construction materials. These devices and method can also be used to connect the walls to each other, for example, at intersections, between adjacent wythes and the like.

For the purposes of this specification, the present invention will be described as being applicable to the attachment to a steel frame building of walls prepared using concrete masonry units ("cmu"), which will also referred to herein as masonry walls. Furthermore, for similar reasons, the Figures will illustrate embodiments wherein the masonry connector of the present invention join the wall to a beam or a truss which are generally parallel to the masonry wall. Column is used to describe a beam that is oriented vertically rather than horizontally. However, it is to be understood that the device and method of the present invention are applicable to buildings having walls and frames constructed of other materials commonly used in the construction industry.

Mortar, as used within the context of the present specification, is meant to be defined as broadly as possible when referring to the material that is applied between individual cmus of the masonry wall, and between courses of cmus, in order to bind the cmus together.

Grout, as used within the context of the present specification, is meant to be the material that is applied to fill the cells within the concrete masonry units of the wall.

Terms such as parallel, vertical, horizontal, and plumb are meant to be used as they are generally defined, but are also meant to encompass variations from such definitions that may be attributable to tolerances generally accepted by the industry, variations mandated by relevant building and construction codes, or changes occurring as the result of settling over time.

An embodiment of the present invention connects a masonry wall built of hollow concrete masonry units to a steel truss, which is generally parallel to, and placed in proximity of, the wall. This embodiment was chosen because the prior art does not address this condition properly. The connection of the masonry wall 10 to the steel truss 36 comprises two main components, the sliding rail 40 and the masonry connector. The sliding rail, as will be described further below, is attached to the steel truss. One end of the masonry connector is joined to the sliding rail, and another end of the masonry connector is embedded in the masonry wall.

Several embodiments of the masonry connector are included in the present invention. A basic embodiment of the present invention is what will be referred to as an "I-Connector", which has two ends, an anchor end which is embedded in the masonry wall, and a hook end which joins the masonry connector to the sliding rail. The hook end can be selected from one of a variety of different configurations (such as those shown in FIGS. 3-1 through 3-9. Additional members can be attached to the "I-Connector" to form embodiments such as a "T-Connector" 60 (FIG. 4-2), "L-Connector" 160 (FIG. 2-3) or "U-Connector" 260 (FIG. 4-3).

FIG. 1-1 is illustrative of the present invention, where a masonry wall 10 comprising a plurality of cmus 12 is joined to the slide rail 40 attached between the top chord 37 and bottom chord 38 of a truss 36 between the truss angles by one embodiment ("T-Connector") 60 of masonry connector.

Sliding Rail

The sliding rail 40 is generally a round solid rod placed in the center and welded to the top chord 37 and bottom chord 38 of the truss between the two chord angles (FIGS. 1-1 and 1-6). The chords are connected by rails 39, the rails being joined to the chords at an angle. This type of structure is known to those skilled in the art, and is generally referred to as an open web.

The slide rails 40 can be positioned so that they are not at the junction of a chord and rail (FIG. 1-7). In this example, two slide rails 40 are positioned between the chords 37 and 38. Various hook member embodiments have been developed to engage such slide rail embodiments (see, for example, FIGS. 3-3 through 3-7).

While the terms "vertical sliding rail", "sliding rail", and "slide rail" may be used interchangeably, this is intended to refer to sliding rails which are mounted vertically. The configuration of the slide rail does not have to be round, as other shapes can be substituted for it, such as, but not limited to, oval, elliptical, triangular, square, rectangular, or other shapes such as pentagonal, hexagonal, septagonal, octagonal and so forth. The present invention also contemplates that the configuration of the slide rail is intended to include shapes other than the previously described shapes, which all have the common characteristic of identically shaped sides; the use of slide rails which have differently shaped sides is also expressly contemplated by the present invention. A slide rail can also have configurations such as that of an "H", "I", or "X", when seen in a plan or cross-sectional view.

Figures 1, 2:
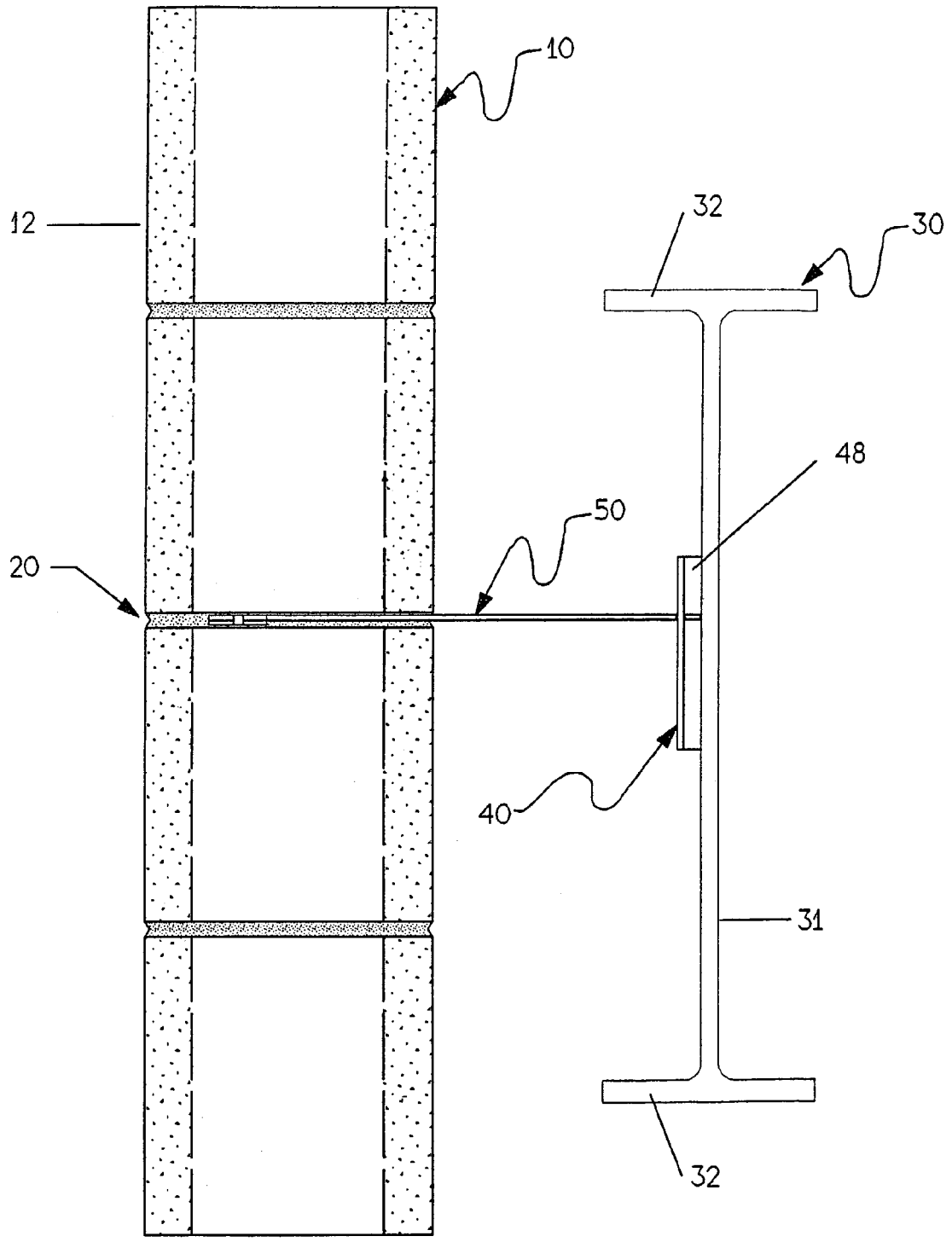
Figures 1, 2, 3:
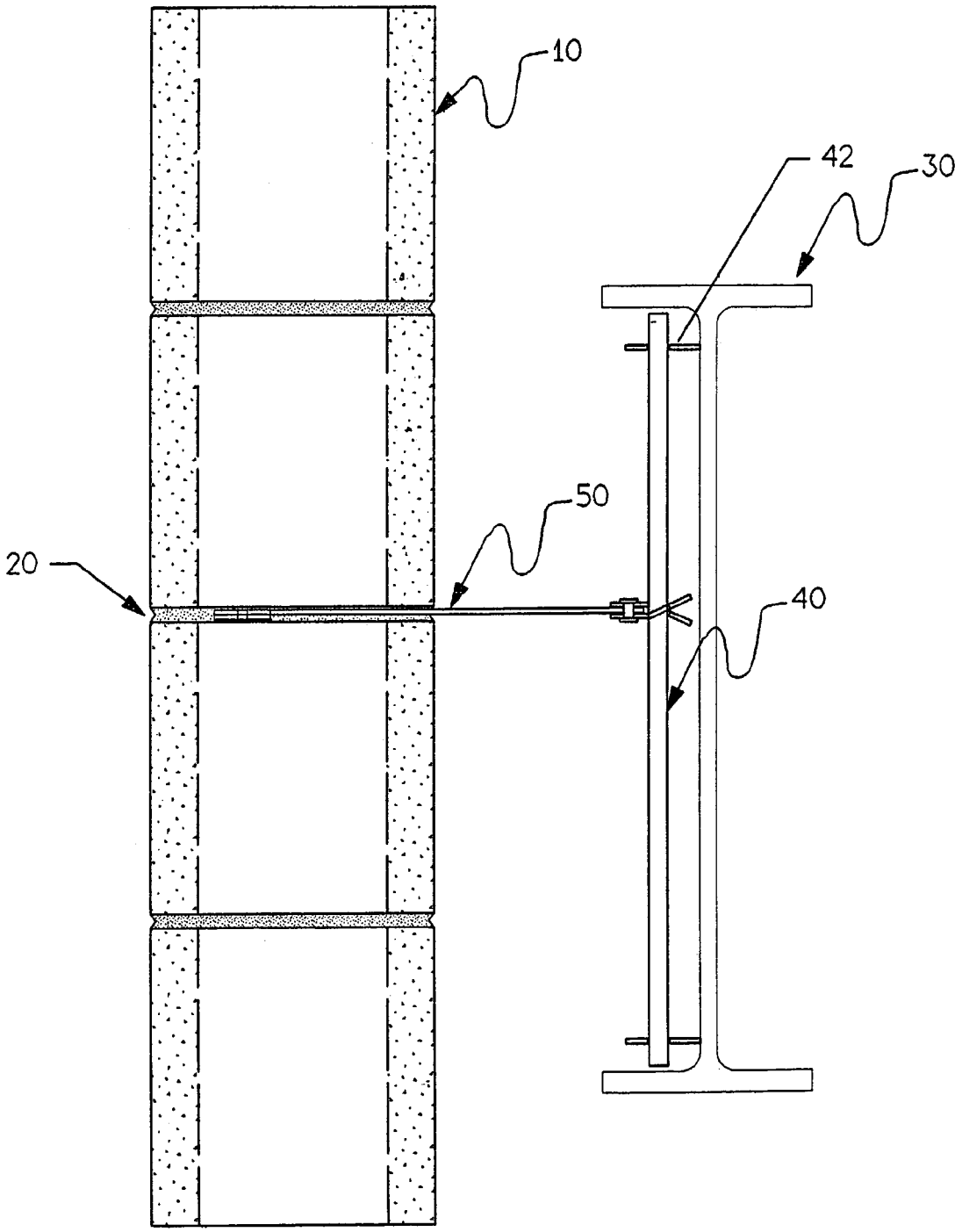
Figures 1, 2, 3, 4:
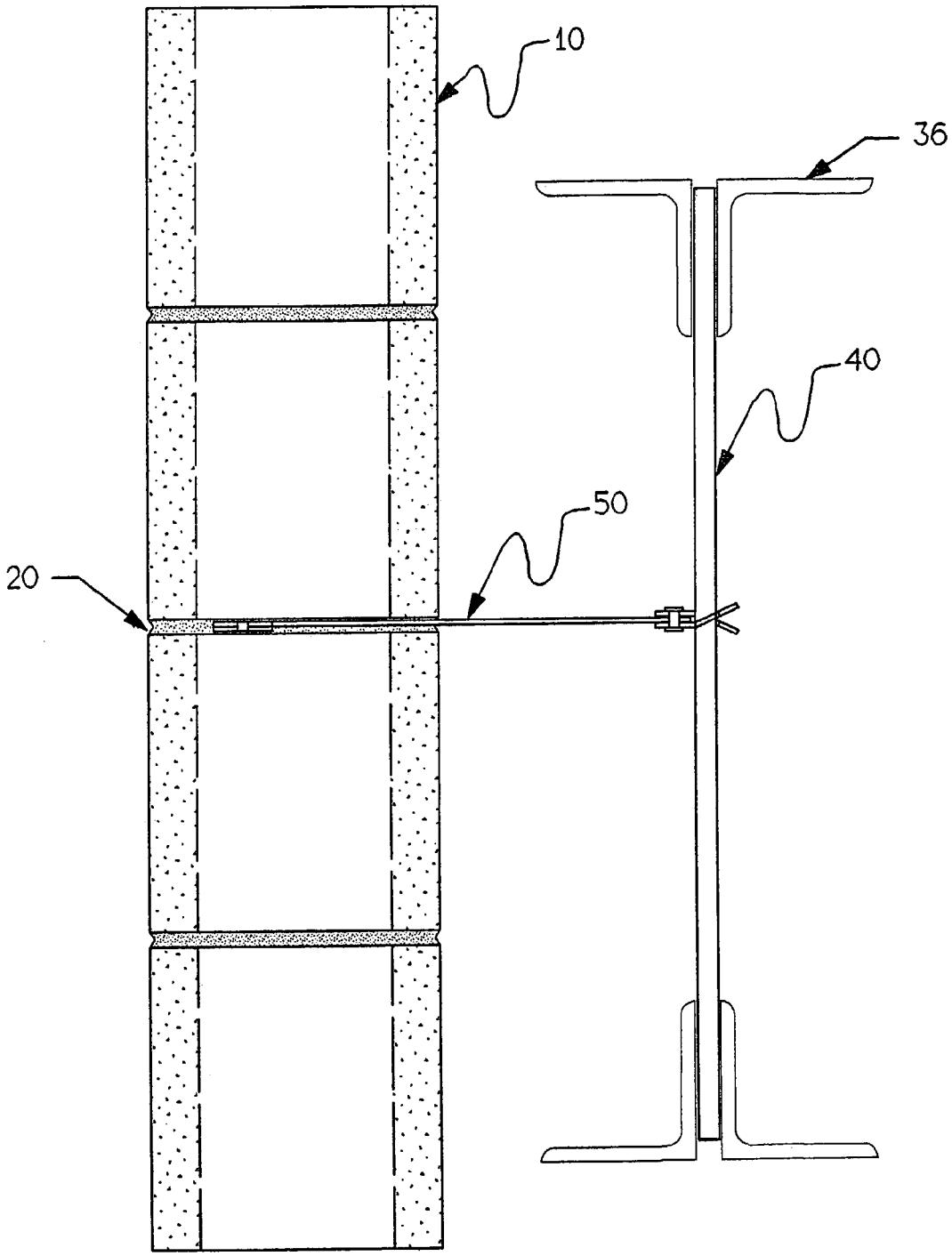
Figures 1, 2, 3, 4, 5:
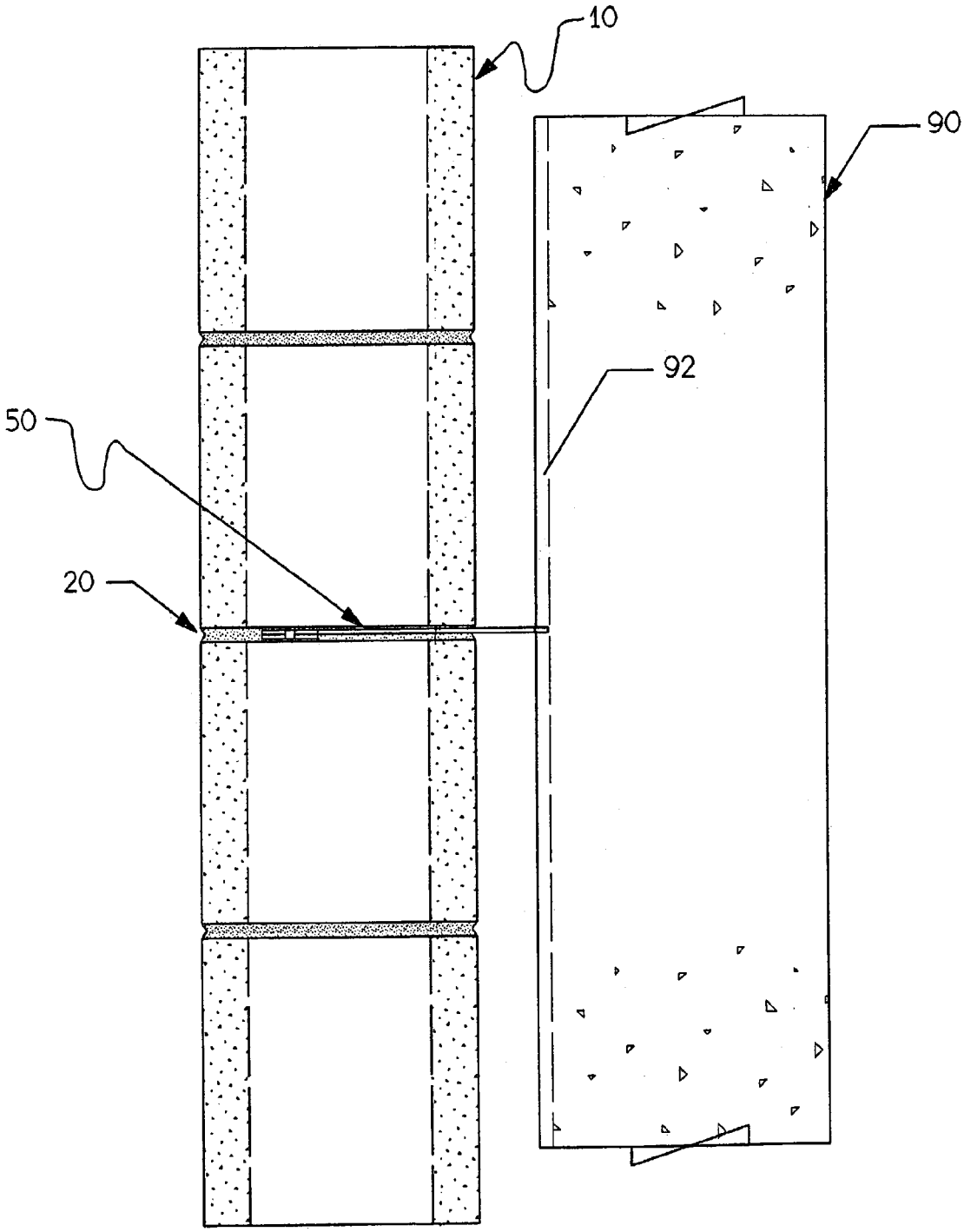
Figures 1, 2, 3, 4, 5, 6:
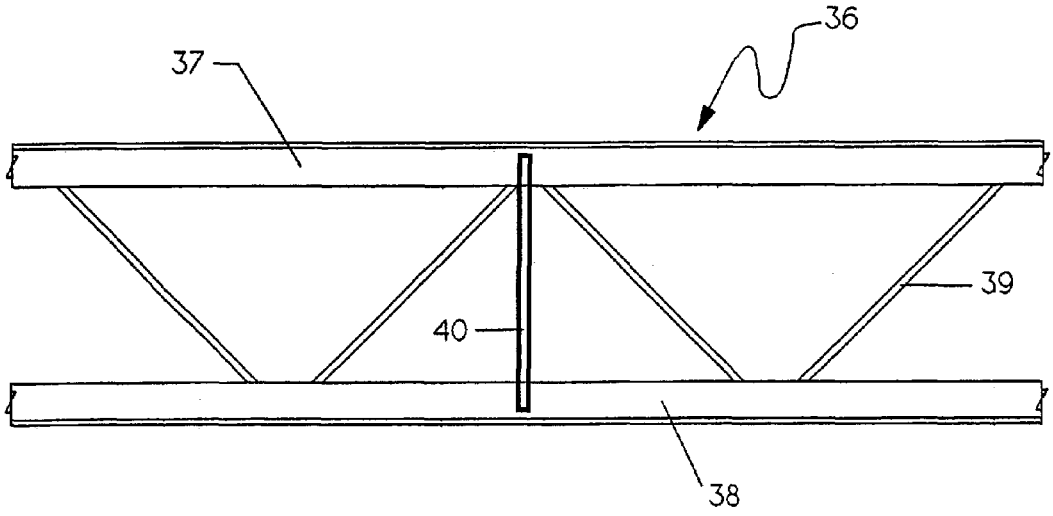
Figures 1, 2, 3, 4, 5, 6, 7:
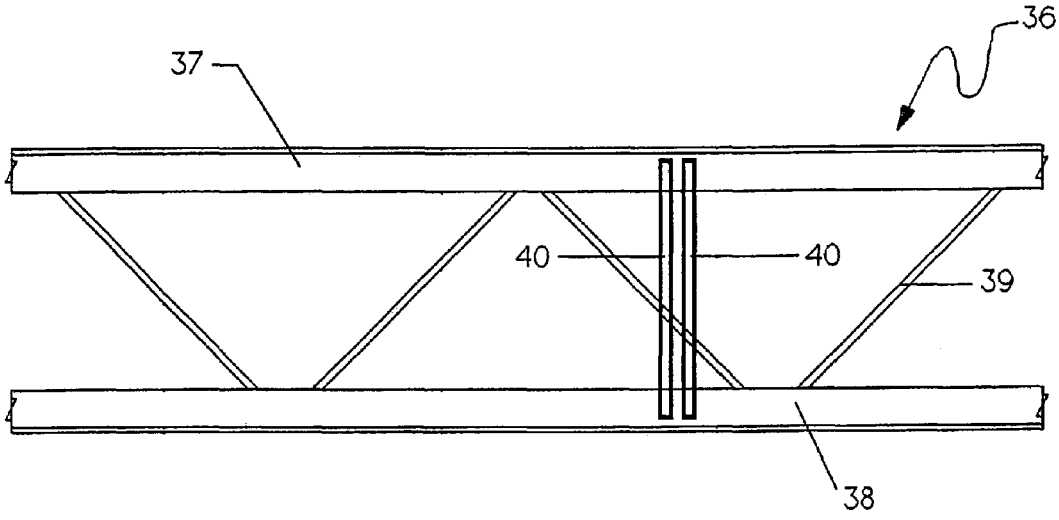
Figures 1, 2:
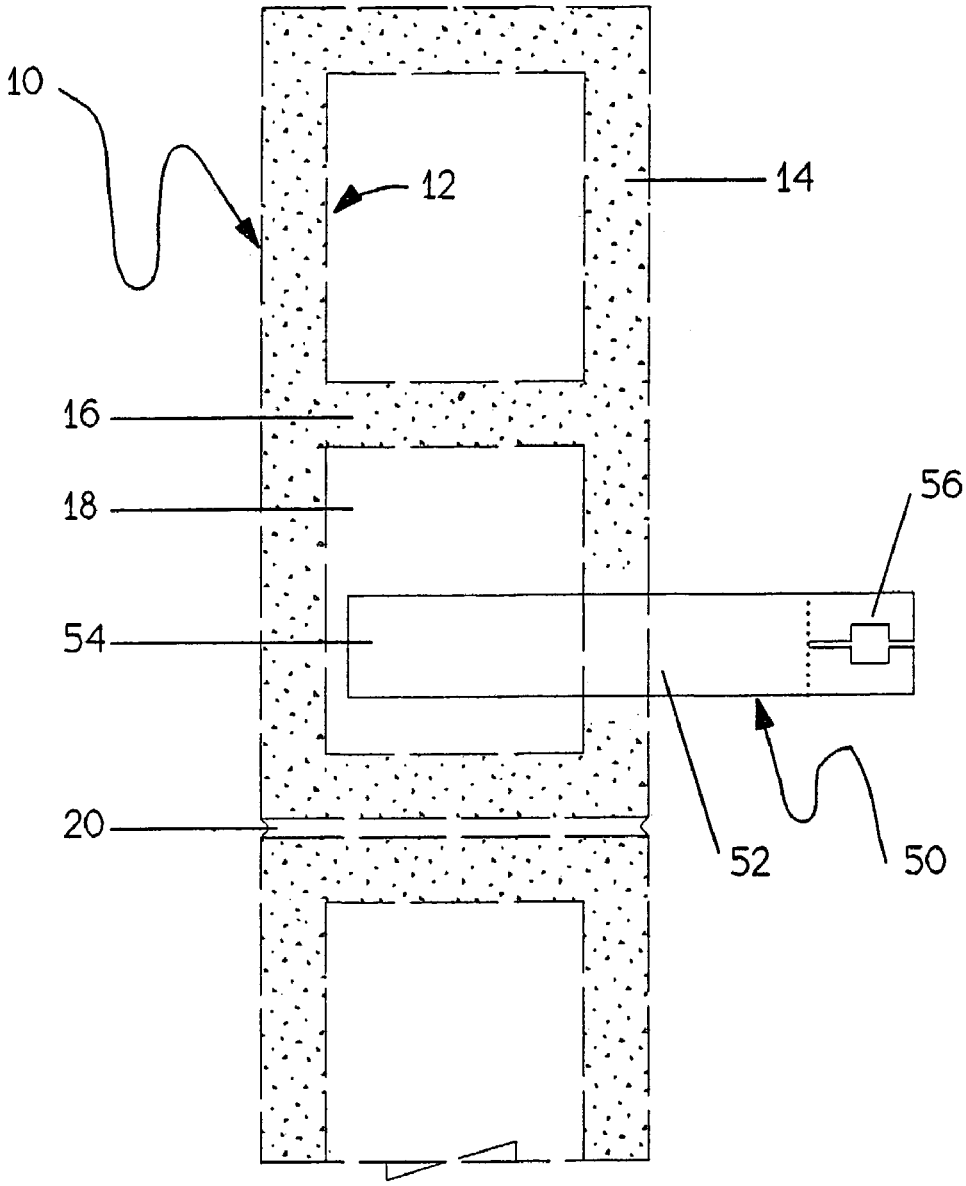
Figure 2:
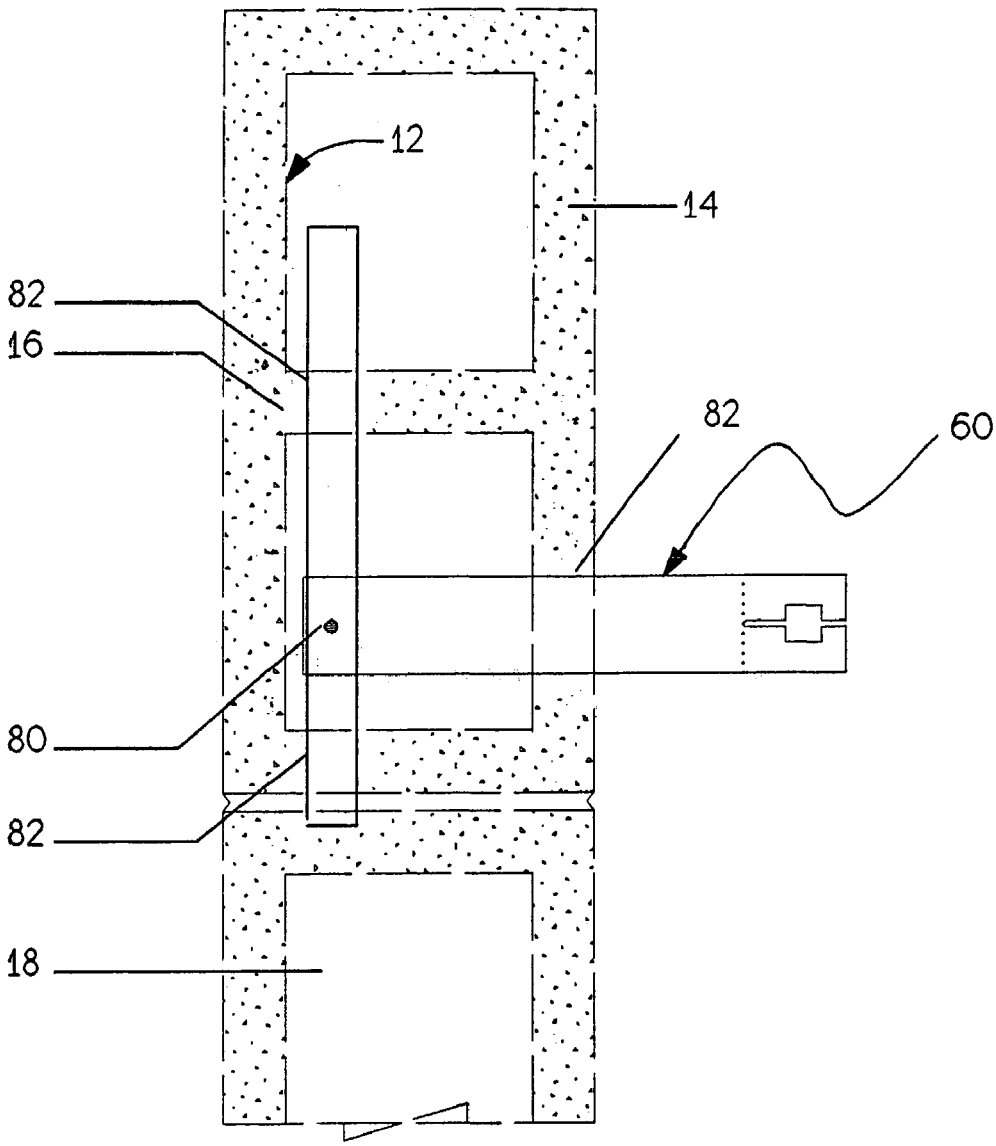
Figures 2, 3:
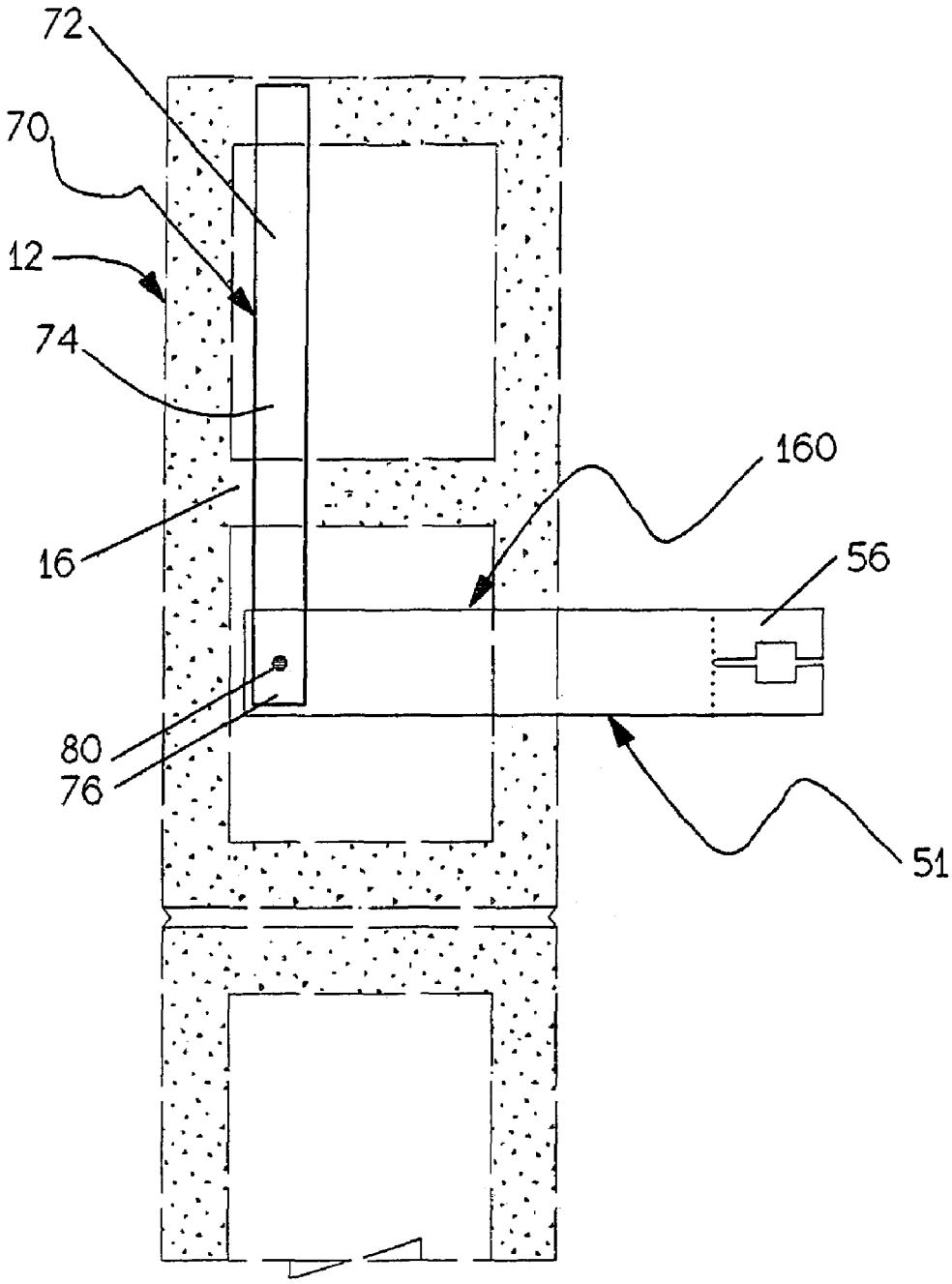
Figures 1, 3:
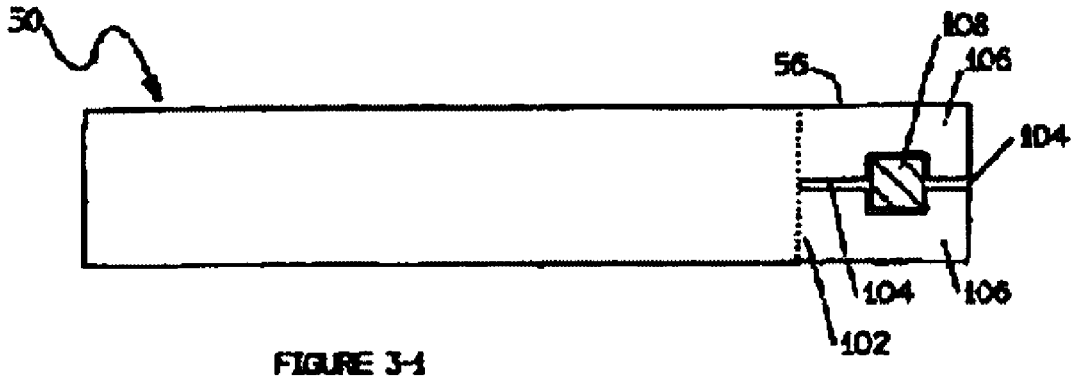
Figures 3, 4, 5, 6, 7, 8, 9, 10, 11:
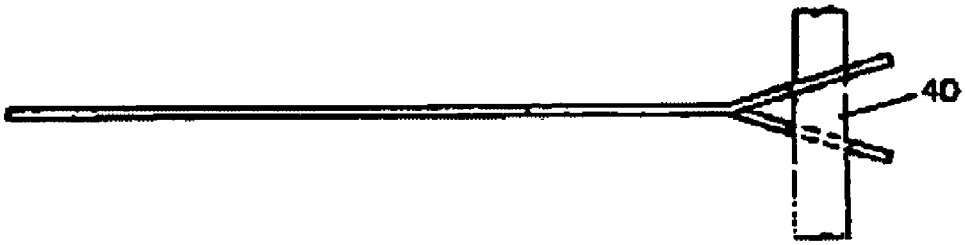
Figures 3, 4, 5, 6, 7, 8, 9, 10, 11, 12:
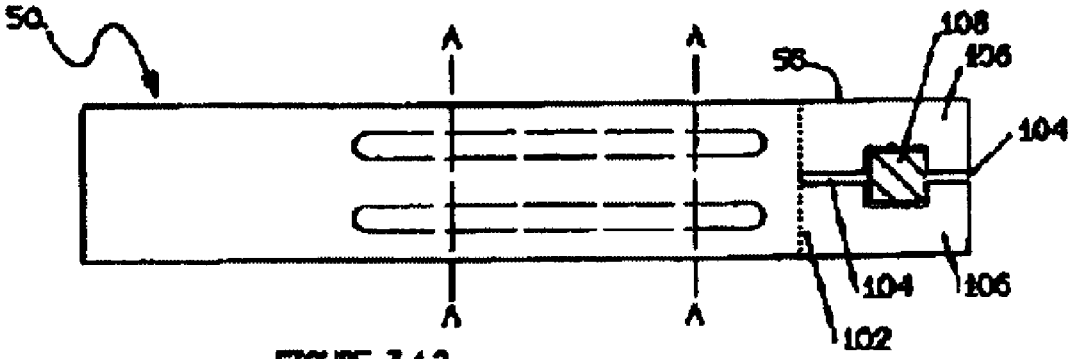
Figures 3, 121:
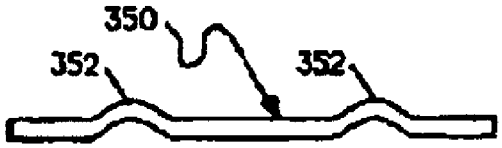
Figures 3, 4, 5, 6, 7, 8:
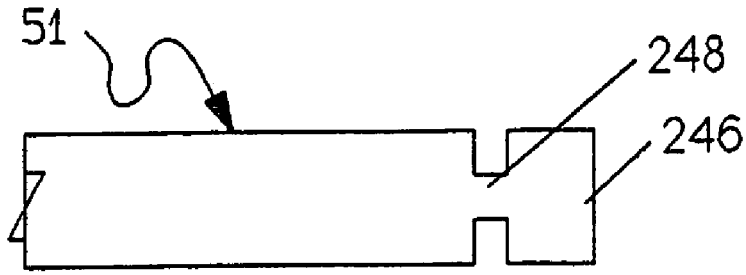
Figures 3, 4, 5, 6, 7, 8, 9:
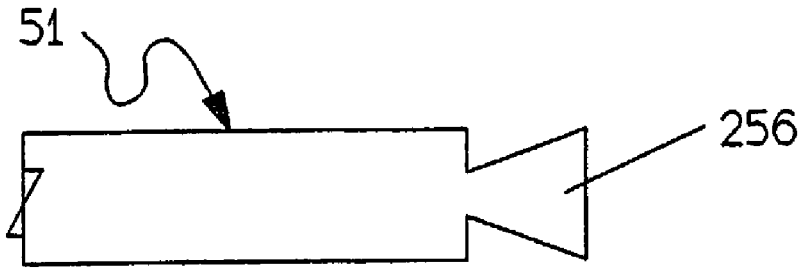
Figures 1, 4:
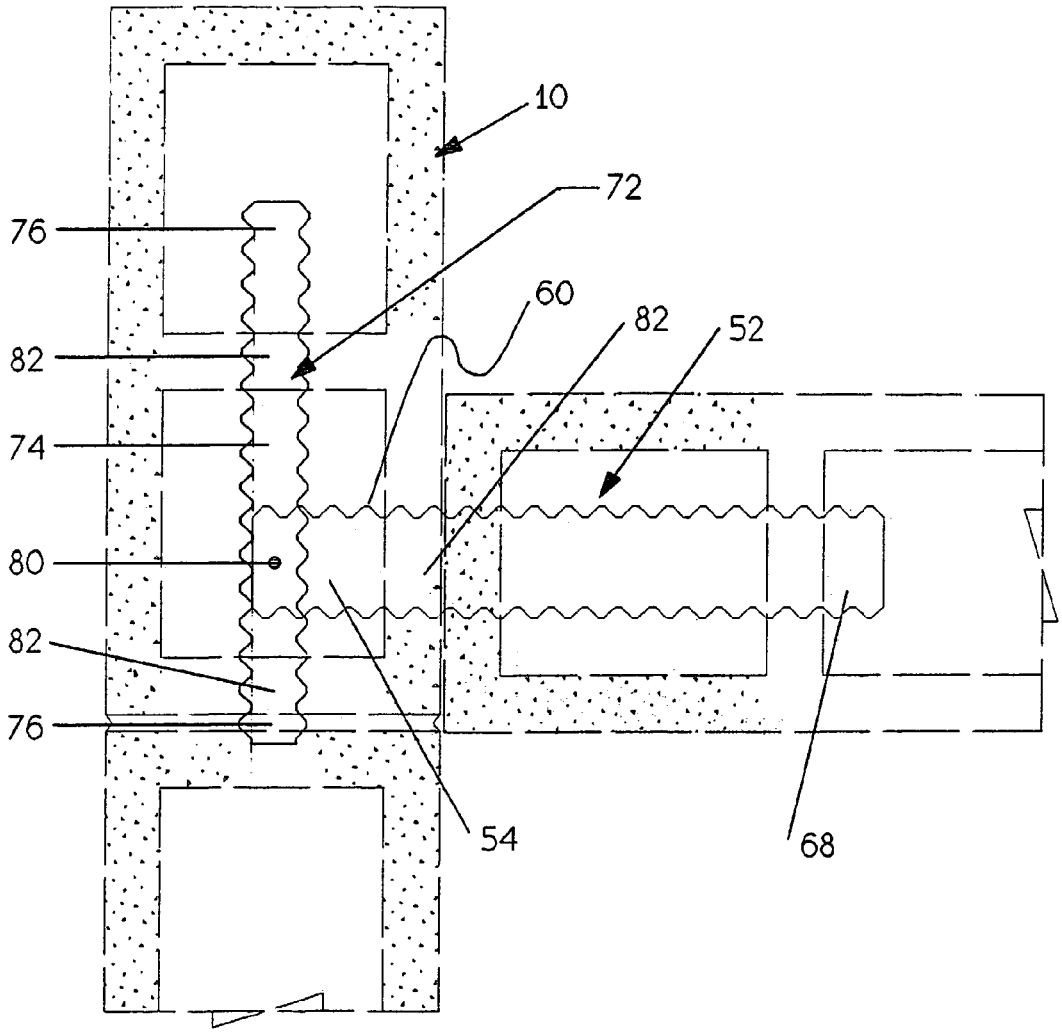
Figures 2, 4:
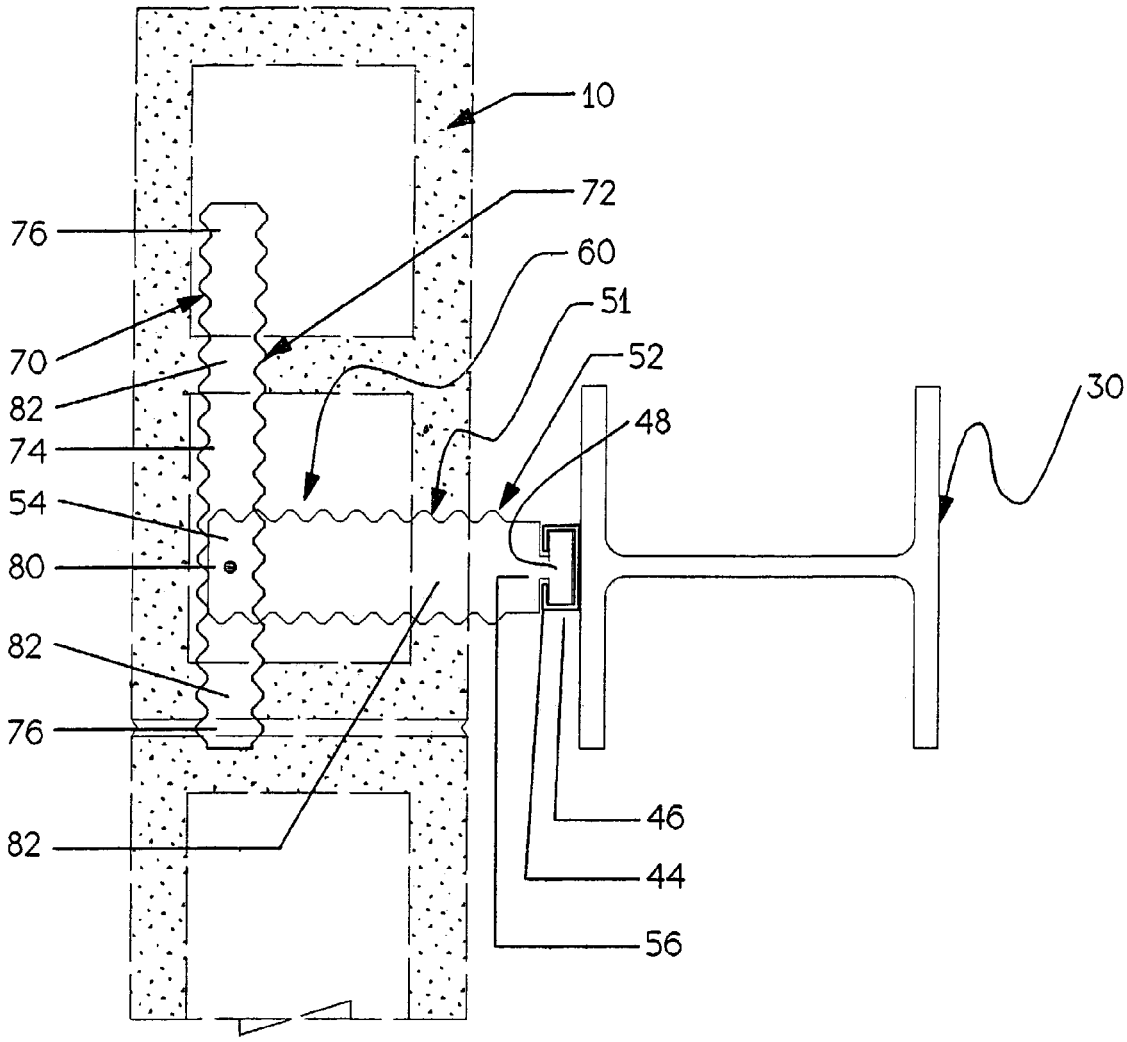
Figures 3, 4:
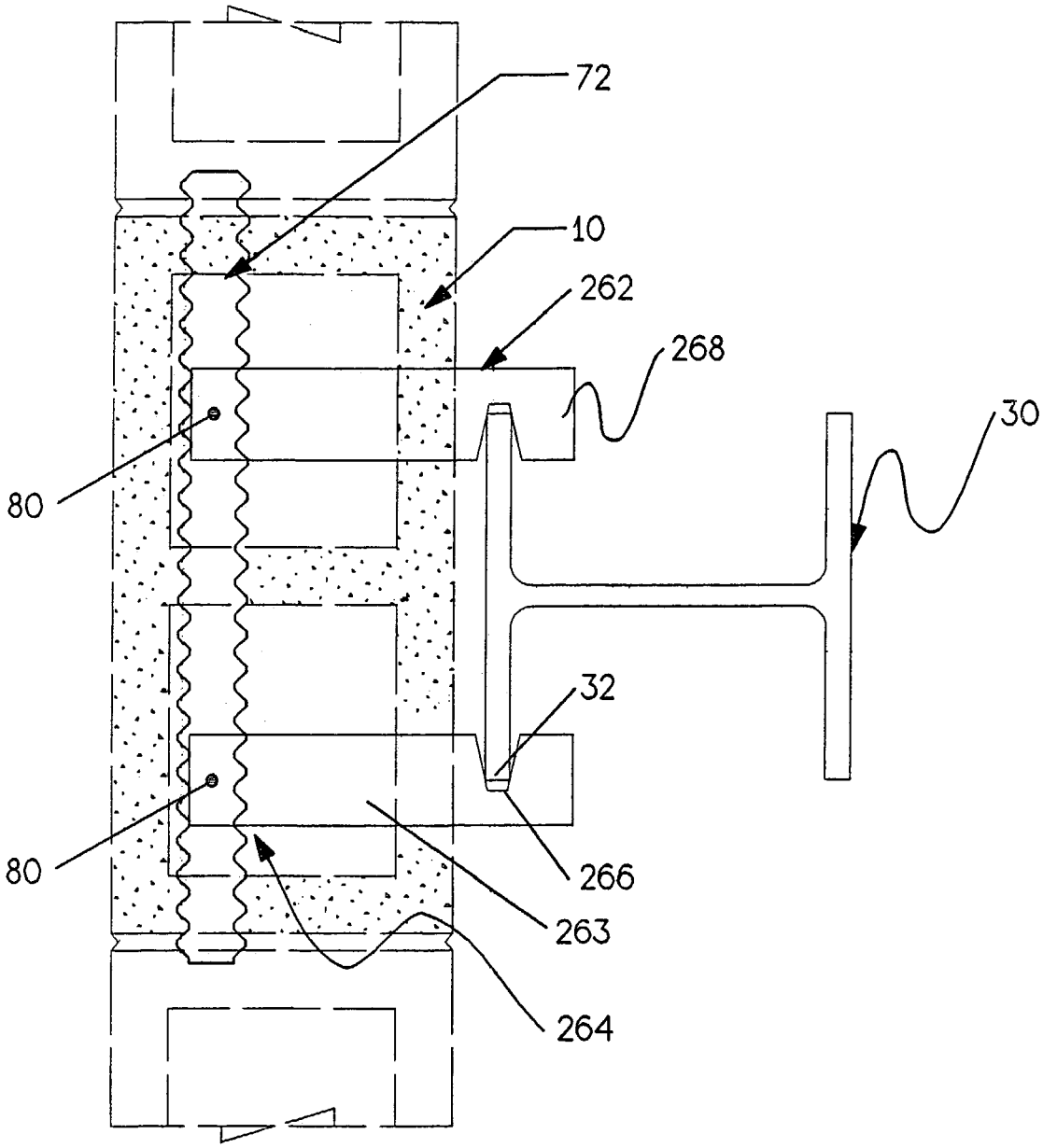

The sliding rail 40 is joined to the beam 30 or truss either with, or without, a spacer plate 42 (FIG. 1-3). Depending upon the size of the spacer plate 42 employed, the sliding rail 40 can be attached to the beam 30 so the sliding rail 40 extends past the edge of the flange 32 and extends above or below the top or the bottom of the beam 30. Joining the sliding rail to the beam is generally done by welding, but any other suitable manner of joining, known to those skilled in the art, or as employed or approved in the industry, can be utilized for joining the sliding rail to the beam or truss. FIG. 1-3 illustrates the sliding rail 40 being attached to the solid web 31 of beam 30, but as shown in other Figures (1-1, 1-6 and 1-7) the sliding rail 40 can be attached to the chords of a truss 36, enabling the use of trusses with open webs in attachment of walls to the building frame. This can result in a cost savings in construction and/or renovation, because using trusses instead of beams requires less steel.

An example of a prior art channel (FIG. 4-2) shows a sliding rail 44 welded to the beam. Sliding rail 44 includes a plurality of walls 46 arranged as shown in FIG. 4-2, and includes a channel 48 along its length. As shown in this top plan view (FIG. 4-2), the "T-Connector" embodiment 60 of the masonry connector of the present invention comprises a hook member 56 which is the "T" hook, enabling embodiments of the masonry connector of the present invention to connect walls to buildings constructed using a conventional sliding rail. This backwards compatibility of embodiments of the present invention allows repairs or renovations of older buildings.

Masonry Connector

Referring to the drawings, FIGS. 1-1 through 1-4 illustrate different manners of connection of a masonry wall 10 to a frame which is generally parallel to the wall 10. As shown in FIGS. 1-1 to 1-3, the frame can include a steel beam 30, or a concrete frame 90 (FIG. 1-5). The wall 10 comprises a plurality of cmus 12, which are generally formed in courses, with the cmus and courses joined by a layer or bed of mortar 20 (FIGS. 1-2, 2-1). Each cmu is formed to comprise walls 14 connected by cross-ribs 16, such that a cell (or hollow area) 18 is formed therebetween (FIG. 2-1). Although not shown in the drawings, the cmu 12 can also be a solid block, or can be comprised of brick or comparable material. The mortar 20 can be any conventional mortar used in the construction industry, or known to those skilled in the art.

The steel beam 30 comprises a web 31 and flanges 32. A sliding rail 40 is fastened to steel beam 30, or to a truss 36. The sliding rail 40 can be a solid rail (FIG. 1-6), or it may made from shaped metal to contain, or a metal plate containing, a channel 48 therein (FIG. 4-2). A connector bar, also referred to herein as a masonry connector or masonry connector bar, 50, is embedded in the masonry wall mortar bed 20 and is joined to the sliding rail 40. The basic embodiment of the connector bar, the "I-Connector", 50 comprises a body 52, a first end 54 and a second end 56, which will also referred to herein as a hook member 56, or hook end. First end 54 of the masonry connector is embedded in the mortar bed 20, the open cells are grouted, and the hook member 56 connects to the sliding rail 40, such that the wall is connected to the frame, when a steel beam is used. There are several embodiments of the masonry connector, which comprise different members, attached to each other in different manners, and with different embodiments of hook members. For example, in FIG. 2-2, there is shown the "T-Connector" embodiment, which includes the "Twist-On Hook", connecting the wall to a sliding rail.

FIG. 1-3 illustrates another manner by which a masonry wall 10 is connected to a steel beam 30 which is generally parallel to the wall. This connector 50 comprises the "Twist-on Hook" embodiment of hook end 56, which can engage any type of sliding rail 40, as described previously. Although not shown in this Figure, this same mechanism of connection can be used to attach the masonry wall 10 to a truss which is parallel to the wall 10. In this arrangement, a portion of the connector bar 50 is embedded in the masonry wall mortar bed 20, and its hook member 56 connects to sliding rail 40. The connector bar 50 can be either a prior art "I-Connector", or one or more embodiments of the masonry connector of the present invention, such as the "T-Connector" 60 (FIG. 4-2) or "L-Connector" (FIG. 2-3). The "L-Connector" differs from the T-Connector in the position where the two members are joined; the members of the L-Connector are joined at their ends.

FIG. 1-4 illustrates another manner by which a masonry wall 10 is connected to a beam 30 which is generally parallel to the wall. In this arrangement, connector bar 50 is embedded in the masonry wall mortar bed 20, and its hook member 56 is positioned along vertical sliding rail 40, which is fastened on the center of a truss 36.

The connection of a masonry wall 10 to a concrete wall or frame 90 that is generally parallel to the masonry wall 10 is illustrated in FIG. 1-5. A connector bar 50 is embedded in the masonry wall mortar bed 20 and positioned in sliding rail 92, which is a channel 92 formed within the concrete wall 90 when the wall has been prepared, using methods known to those skilled in the art. Channel 92 is shaped so as to be complementary to the shape of a dovetailed tenon, such as hook ends 246 and 256 (FIGS. 3-8 and 3-9, respectively) enabling the sliding engagement of the hook end within the channel 92. The channel can be formed to have any of a variety of shapes, to accommodate connector bars having different configurations of dovetailed hook ends, such as those shown in FIG. 3-8 ("T-hook" 246); or FIG. 3-9 ("dovetail hook" 256) or other configurations known to those skilled in the art.

The masonry connector bar of the present invention is designed to accommodate the various connection mechanisms, such as those shown in FIGS. 1-1 through 1-4. The connection serves to restrict the movement between the wall and the steel frame in some directions while allowing movement in other directions. In general, the vertical freedom of movement is achieved by allowing the hook end to slide along the vertical sliding rail. The lateral movement, in either direction, can be achieved by over-sizing the loop in the hook end or the opening in the spacer plate 42, where one is used, in the direction of the allowed movement. By over-sizing the loop, masonry connectors of the present invention can be used with sliding rails having numerous shapes and configurations.

The masonry connector of the present invention can be used in one of the following embodiments: an "I-Connector" 50 (FIG. 2-1); "T-Connector" 60 (FIGS. 2-2 and 4-2); "L-Connector" 160 (FIG. 2-3); or "U-Connector" 260. (FIG. 4-3).

"T-Connector" Embodiment

A "T-Connector" embodiment 60 of a masonry connector of the present invention comprises a first member 51 and an anchor member 70 joined to each other (FIGS. 2-2, 4-1 and 4-2). This masonry connector embodiment is embedded in a masonry wall 10, as shown in FIG. 4-2. Hook member comprises a body 52 terminating in a first end, 54, which is the end usually embedded in the mortar 20, and a second end 56, which is a hook end. In the example shown in FIG. 4-2, hook end 56 is a "T" hook, designed to fit a sliding channel 48 characteristic of prior art slide rails.

The body 52 and first end 54 can be flat or corrugated, can have straight or serrated edges, perforations or dimples, etc. to increase its bond in the mortar bed. The length of the body 52 is based on the design length minus the allowable tolerance (pursuant to construction codes), so whether the distance in the field is shorter or longer, the body is embedded efficiently in the mortar bed. This masonry connector embodiment is suitable for hollow masonry in which the depth of embedment can vary, while still maintaining adequate resistance to applied forces. While the hook end 56 illustrated is a "T" hook which is shaped to fit within the sliding channel of prior art devices rods, it is to be understood that the hook end of this embodiment can be any other type as well, such as the "Dove Tail" hook (FIG. 3-9) to engage a channel 92 embedded in concrete wall, or other types of hook members and sliding rods.

Anchor member 70 comprises a body 72, middle region 74 and two ends 76. The members are connected proximate the first end 54 of the first member, and near the middle region 74. In one embodiment, the members are pivotably connected by a fastener 80. The members may also be attached at or near the midpoint of the anchor member 72. Fastener 80 can be a rivet, pivot pin, set screw, screw, bolt, or other fastener known to those skilled in the art. The total thickness at the rivet or other fastener should be such that the fastener fits within the mortar joint.

In another embodiment, the hook member and anchor member are joined so they do not pivot, such as in a rigid manner by adding an additional fastener, or by welding, soldering, brazing or other methods of joining materials that are known to those skilled in the art.

When embedded in the mortar bed 20, the "T-Connector" embodiment 60 provides at least three points of anchorage 82 in hollow masonry, even as the embedment depth of the connector is varying. The three points of anchorage 82 (FIGS. 2-2 and 4-1) offer greater contact than can be obtained with the single point of anchorage of masonry connectors used in accordance with current construction practice (such as shown in FIG. 2-1).

First member 51 is shown (FIGS. 3-1.3 and 3-1.3.1) as being manufactured from a corrugated material; this is merely an illustration of one embodiment. It is explicitly contemplated that first and anchor members can be made from flat material (for example only, the embodiments shown in FIGS. 2-1 through 2-3) or from a reinforced material (FIG. 3-1.2.1). It is also contemplated that these members can be manufactured from galvanized steel plate, which can be flat or corrugated, can have straight or serrated edges (serrations shown in FIG. 3-1.4 as reference numeral 58), perforated surfaces (perforations shown as reference numeral 59 in FIG. 3-1.5) or dimpled surfaces etc. to increase their bond in the mortar bed. Anchor member 70 as illustrated herein is also made from corrugated material, but can also be manufactured from flat or reinforced materials, similar to those used for first member 51. One such embodiment of masonry connector (the "T-Connector" 60) is particularly suitable for hollow block wall in which its depth of embedment can vary, while still maintaining adequate resistance to applied forces.

The length of the anchor member for standard block should be approximately 6" on the short side and 10" on the long side. Standard block generally comprises two cells contained within its walls. The anchor bar ends will be embedded in the mortar bed over a cross rib of the block, either as shown in the Figures, or flipped, as appropriate for the particular construction job. The anchor bar can rotate about the connecting rivet, so if required, it can be closed or rotated to flip its direction. The hook bar, attached at the embedded end to the anchor bar, described above, has a "Twist-on Hook" (see, for example, FIGS. 3-2 and 3-2.1) attached to its other end, so it can be engaged by a push and twist action to the slide rail.

"L-Connector" Embodiment

The "L-Connector" embodiment 160 is similar to the "T-Connector" embodiment 60; the members in the "L-Connector" embodiment are joined proximate their ends (FIG. 2-3). In this embodiment, the anchor member 70 is attached to first member 51 proximate the anchor bar first end 76, there "L-Connector" embodiment having a longer anchor leg than the "T-Connector" embodiment. The "L-Connector" embodiment 160 is particularly suitable for hollow block wall in which its depth of embedment can vary, while still maintaining adequate resistance to applied forces.

The anchor bar 70 is designed to be embedded in mortar along the cross ribs 16 of the masonry block 12. The anchor bar 70 can be designed to have a shorter length, to be embedded over at least one cross rib 16 of the block. The anchor bar 70's length can also be made longer, so the anchor bar can be embedded over at least two ribs of the block, depending on the forces that the wall will be expected to withstand. The length of the anchor bar can be shortened by taking into account that if necessary, it can be flipped over to suit the particular situation. The fastener 80 serves as a pivot, to rotate the first member 51, as may be necessary for erection or embedment.

Where necessary, this single fastener articulating connection can be made into a rigid connection by making the anchor member 70 integral with the first member 51, such as by joining them with two or more fasteners 80, or by welding, soldering, or other means of connection known to those skilled in the art. Using these forms of joining, the two members will not pivot.

The depth of embedment of the "L-Connector" embodiment 160 can vary, without reducing its embedment strength critically. The anchor and first members (70 and 51, respectively) of this embodiment, similar to those described for the previous embodiments, can be flat or corrugated, they can have straight or serrated edges and perforations or dimples, etc. to increase their bond in the mortar bed. The hook end 56 is a notched hook (FIG. 2-3) to enable this embodiment to fit a slide rail. Alternatively, the hook end 56 can be any other type, to suit prior art sliding rails such as the "Dove Tail" embodiment 256 (FIG. 3-9) to suit the embedded slot of a concrete wall, or similar. The length of the bar is based on the design length minus the allowable tolerance, so whether the distance in field is shorter or longer the bar is embedded efficiently. The "L-Connector" embodiment 160 of the present invention is suitable for use with solid and hollow masonry.

"U-Connector" Embodiment

FIG. 4-3 illustrates using a "U-Connector" embodiment 260 of the present invention to join a cmu wall to a frame that lacks any type of channel or slide rail for receiving a masonry connector. This embodiment comprises two hook bars 262 pivotably attached to an anchor bar 72, each hook bar 262 being connected to the anchor bar 72 by a single fastener 80. The anchor bar 72 of this embodiment is designed to be embedded in mortar along the adjacent cross ribs 16 of the block 12. The length of the anchor bar 72 can be shortened by taking into account that if necessary, it can be flipped to suit the desired configuration. The fastener 80 serves also as a pivot, to rotate the hook bar, as may be necessary for erection or embedment. In some cases the single fastener articulating connection can be made a rigid connection, by providing two or more fasteners or by welding, in the manner described for a previous embodiment (the L-Connector embodiment 160) of the present invention.

In the "U-Connector" embodiment, the hook bar 262 comprises a body 263, a first end 264, and a slot 266 formed within the body but proximate to second end 268. The slot 266 is formed so as to be in slidable engagement with the flanges 32 of the steel beam 30.

The depth of embedment of the U-Connector" 260 embodiment within the mortar bed 20 can vary, without reducing its embedment strength critically. Note the multiple points of contact of the masonry connector with the walls of the cmu. The length of the connector bar is based on the design length minus the allowable tolerance, so whether the distance in the field is shorter or longer, the bar is embedded efficiently. This connector embodiment is suitable for use with solid and hollow masonry.

Hook End Embodiments

FIGS. 3-1.1 through 3-9 illustrate different hook end embodiments. Referring to FIG. 3-1, second end 56 of this embodiment comprises a bend region 102, and a slit 104 along the length of the hook end, which divides the hook end into tabs 106. The hook end can be flexed and bent; the bend region 102 is positioned such that is between the very end of the hook, and below the location of any slit, opening, notch, aperture or the like that may be present in the hook. Note that while the bend region is shown in the embodiment illustrated in FIG. 3-1, it is to be understood that such a region is optional, and may or may not be present in other embodiments of the hook members.

Each tab 106 contains a notch 108 therein, the notches being sized to receive a slide rail therein and between the tabs 106. In use (FIG. 3-1.1), the tabs 106 are bent in opposite directions (away from the plane of the hook member) to expose the notches. The hook member is then rotated to a position such that the tabs 106 substantially encircle the slide rail 40 and the hook member is then rotated to a position where the notches 108 will engage the slide rail. The masonry connector can then be embedded in mortar after the anchor member is positioned over the appropriate cmus. The shape of the notch 108 in the embodiment shown in FIG. 3-1 is not critical; the notch or form of the hook end can be any shape, provided that the slide rail is engaged therein.

A second configuration of hook member is shown in FIGS. 3-2 and 3-2.1. Hook 116 comprises a pair of hook components 118 (FIG. 3-2), each hook component 118 being arcuate and terminating in a hook end 120, which can be twisted around, and substantially encircle the slide rail 40 (FIG. 3-2.1). FIG. 3-2.1 shows that hook 116 can be made by joining different pieces (50 and 130) to each other, using methods such as welding, soldering, brazing, or other methods of joining known to those skilled in the art. It is to be understood that the present invention also contemplates manufacturing the hook end from fewer pieces, such as a combination piece comprising 50 and a single piece 130, and joined to a second piece 130, or from one piece molded to form the tabs. The embodiment illustrated in FIGS. 3-2 and 3-2.1 is also an example of a "Twist-On Connector", similar in use to the embodiment shown in FIGS. 3-1 and 3-1.1.

In a top plan section the hooks 120 create an enclosure around the sliding rail 40 (FIG. 3-2). The hooks are bent to create a gap between them, as seen in a cross-sectional view (FIG. 3-2.1). The hooks 120 can be made of steel having a spring or spring-like quality, so that the gap can be made smaller and be able to force the sliding rail 40 to slide between them. The insertion of the hook is made by a push and twist action. The hooks 120 are rigidly joined to the hook bar or body of the masonry connector by means of a fastener 80 (not shown), or by welding, soldering, or other means of joining known to those skilled in the art. In some cases the hook end of the body (hook bar) can be shaped so as to replace one of the hook members. Although not expressly shown in the figures, this novel hook member can be used on embodiments of masonry connectors having the "T-Connector" 60 and "L-Connector" 160 configuration. The new hook and masonry connector embodiment can be used as indicated above, or in other combinations, as appropriate for a particular situation, and such combinations are contemplated to be within the scope of the present invention.

Another embodiment 136 of a hook end, shown in FIGS. 3-3 through 3-3.3, comprises two members 138 (FIG. 3-3.2) and 140 (FIG. 3-3.3) joined together by a fastener 80 (FIG. 3.3.1). Receiving member 138 comprises a pair of tabs 142, each tab having an opening 144 therethrough, the opening 144 being sized to receive, and receiving, the fastener 80 which joins the members. Fastener 80 can be a rivet, screw, pivot pin, nut and bolt combination, or any other fastener known to those skilled in the art. Closing member 140 is formed from a single piece of material, and can be bent or folded along region 146, such that when closing member 140 is folded (FIG. 3-3.2), its closing tabs 148 make contact with receiving member tabs 142. The openings 144 align with the openings of the receiving member 136, enabling the fastener 80 to be inserted therein. The gap 139 formed between the two members is sized so as to retain one or more slide rails therein. This embodiment of masonry connector can be inserted over a slide rail before the slide rail is completely joined to the beam or truss. Its multipiece construction also enables it to be positioned over one or more slide rails after the slide rails have been joined to the truss or beam.

FIG. 3-4 is another embodiment 166 of the hook member illustrated in FIGS. 3-3 through 3-3.3; this embodiment is produced using a single sheet of material, and has a gap or opening 168 that is sized such that one or more slide rails can be retained therein.

Embodiment 176, designed specifically for two slide rails (FIG. 3-5) contains a pair of spaced openings 178, each opening being designed to receive a slide rail therein. It is to be understood that another embodiment of this hook member, containing a plurality of openings, is also contemplated to be within the scope of the present invention.

Embodiment 186 (FIG. 3-6) comprises notches 188 on the outer edges 190, enabling this hook member embodiment to engage two slide rails. In use, this hook member is rotated to a position such that the hook end can fit between the slide rails, and the hook member is then moved such that each notch 188 engages a slide rail 40, and then the first end is embedded in mortar, as has been previously described.

Hook end embodiment 196 (FIG. 3-7) can also have multiple configurations; a hook member may contain a notch 198 along one side. Two hook members, each containing a notch 198, can also engage the multiple slide rails 40, and their anchor ends embedded in mortar once the slide rail is engaged within the notches 198. Alternatively a single hook member can be used, wherein its hook end comprises two tabs, each containing a notch that will accommodate a slide rail.

FIGS. 3-8 and 3-9 illustrate hook members having hook ends configured to fit within conventional channels such as 48, 92, the hook ends 246 (FIG. 3-8) and 256 (FIG. 3-9) being a dovetailed tenon, the tenon 246 fitting channel 48 of a conventional slide rail (FIG. 4-2) or tenon 256 fitting the channel 92 of a conventional masonry frame (FIG. 1-5). As shown in these Figures, tenon 246 is a rectangle connected by a neck 248, or is attached directly to the hook member (FIGS. 3-8 and 3-9, respectively). The present invention contemplates the use of other configurations of dovetailed tenons which are capable of fitting within the channels of the frame.

Other variations of the hook member which are contemplated by the present invention, include a closed loop, or a loop having an opening along its surface. The open loop variation of the hook member can be used on slide rails that have not been joined to the frame, or on slide rails that have been joined, by flexing the loop a distance sufficient to allow the loop to wrap around the slide rail, closing the loop to retain the slide rail therein, then embedding the first end of the connector in the mortar.

The figures herein illustrate these hook end embodiments as being manufactured from flat material. However, it is to be understood that corrugated material, or reinforced material (represented by reference numeral 350, with reinforced regions or stiffeners 352 being distributed along the length of the hook bar, FIG. 3-1.2.1), or dimpled or perforated materials can also be substituted for their manufacture, and are explicitly contemplated by the present invention. Depending upon their ultimate configuration, the hooks can be also made of steel rod, bar or wire, or other material having sufficient strength and durability for construction, as known to those skilled in the art.

EXAMPLES

FIGS. 4-1 through 4-3 demonstrate examples of typical additional uses for embodiments of the present invention.

FIG. 4-1 illustrates using the "T-Connector" embodiment to join two walls, where the masonry connector of the present invention has several points of attachment with each cmu. FIG. 4-2 further illustrates using this embodiment to connect a masonry wall to a steel beam or truss which has a conventional channel 48.

The components of the masonry connector embodiments are preferably manufactured from steel plate or bar, which is either cut, bent, or molded to suit the particular embodiment. The steel can be of regular or high strength and can be plain finish, galvanized, stainless steel or any other finish. The hook and anchor bars can be flat or corrugated, they can have straight or serrated edges and punches or dimples, etc. to increase their bond in the mortar bed. The components of the present invention can also be manufactured from other non metallic materials which are compatible with the masonry reinforcing materials and the steel frame.

The masonry connector of the present invention can also be configured as an assembly or system, such as one of the combinations shown in FIGS. 1-1 through 1-4, comprising the connector bar 50 and the sliding rail 40. The sliding rail 40 has been described previously herein.

In addition to its use in connecting a wall to a frame, beam or truss, or to another wall (FIG. 4-1), the present invention can be used for connecting walls which have a space between them, as is characteristic of what is known to those skilled in the art as cavity walls. Further, the present invention can be used for connecting veneer walls to an interior wall.

Method of Attachment

A wall can be attached to a frame using various embodiments of the present invention, according to the following method. A worker will position a masonry connector at such an angle that will allow the hook member to engage the channel 48, and after the hook end has been engaged within channel 48, reposition the masonry connector such that the hook end remains in the channel, and the anchor end is then positioned above the upper surface of the cmu. The masonry connector is then embedded in mortar to complete the attachment process. The cells in the blocks comprising the masonry wall are not grouted.

For those situations in which a slide rail 40 is present, the hook end is positioned such that it engages the slide rail. The particular positioning step depends upon the configuration of the hook member being used. In certain embodiments a second member may be folded over and attached to a first hook member, to engage the slide rail therebetween, as has been described in a previous section. Once the slide rail has been engaged within the hook member of the connecting device, the anchor end of the masonry connector is then embedded in mortar to complete the attachment process. The cells in the blocks comprising the masonry wall are not grouted.

The connecting devices of the present invention, and the method of the present invention do not require that the cells be grouted in order for the connection to have adequate strength. In certain embodiments, such as that shown in FIGS. 3-1 and 3-3, it may be necessary for the construction worker to separate the tabs or hooks by bending, to enable the hook member to fit around the slide rail 40, and after the slide rail is retained within the hook, to bend, twist or otherwise reposition the tabs or hooks to retain the slide rail therein. The process is repeated as additional masonry connectors are added, their number and positions varying according to engineering and code requirements.

When connecting a wall to a concrete frame, the worker will position a masonry connector at such an angle that will allow the hook member to engage the channel 92, and after the hook end has been engaged within channel 92, reposition the masonry connector such that the hook end remains in the channel, and the anchor end is then positioned above the upper surface of the cmu. The masonry connector is then embedded in mortar to complete the attachment process. The cells in the blocks comprising the masonry wall are not grouted.

Advantages

The present invention has the following advantages:

1. The new masonry connectors, such as the "T-Connector", the "L-Connector" and "U-Connector" embodiments, introduce an anchor bar, which assures that the connector will have additional points of anchorage within the masonry compared to prior art devices. Thus, the "L-Connector" introduces a minimum of two points of anchorage, and three points of anchorage for the "T" and "U" Connectors. This additional anchorage is especially useful in a hollow block wall, where a prior art connector may end with only a single point of anchorage, thus reducing it's resistance to transverse forces and providing inadequate resistance to longitudinal shear forces. Further, use of the connectors or the present invention will not require grouting of the open cells to achieve adequate strength.
2. The new masonry connector embodiments introduce a new connector that can have an adjustable depth of embedment, and still provide adequate resistance to the applied forces, even in a hollow block wall. This adjustable depth of embedment is useful as a means to compensate for differences due to construction tolerances.
3. The new system introduces a new hook member, an embodiment of which is referred to as a Twist-on Hook, which allows the connector to be hooked onto a sliding rail of standard cross-section, such as a round bar, pipe, rectangular bar, structural tubing and the like. This is useful when connecting to a joist, joist girder, or a truss. This hook member can be also used in a similar manner in conjunction with a beam.
4. Embodiments of the masonry connector of the new system can utilize either an embodiment of the novel hook members, or any other prior art hook member that fits a prior art corresponding sliding rail, enabling the system's use in new construction as well as with existing construction.
5. The wide range of available sections to be used as sliding rails, is enabled by the newly designed hook member of the present invention. This allows the use of a more efficient rail than the prior art rails. The new rails can economically span much longer than the prior art rail, thus allowing the use of those rails for trusses, which unlike beams, have no web to support them.
6. The new system allows the attachment of the sliding rail to the outside face of the beam or truss, thus allowing for the use of a longer rail, where needed, than has been able to be used previously. This is especially useful for small steel beams or trusses that are 10 inches deep or less, where, in the prior art, there was not often enough sliding range for the beam to freely deflect because the vertical sliding rail was attached to the flat surface of the beam web.
7. It is very advantageous and more economical to install the steel beams or trusses adjacent to the masonry wall, rather than to build into it. The new masonry connector system of the present invention provides a much stronger and more versatile connection, that can be applied on virtually any type of steel member that is approximately parallel to the masonry wall. Thus, the new connector of the present invention promotes the placement of the steel beams and trusses adjacent to the walls, which in turn will lower the overall cost of the construction significantly, in contrast to the weaker and less versatile connections characteristic of prior art devices.
8. In many buildings, it is advantageous and more economical to use the masonry walls as shear walls. When the steel beams, trusses and girders are placed adjacent to the wall, the shear forces are transferred through the connectors. This situation causes additional stress on the embedment of the connector bar as well as on the vertical sliding rail. Prior art connections provided a limited strength vertical sliding rail for a beam, and offered no adequate vertical sliding rail for a truss. Additionally, the prior art embedment method cannot assure the depth of embedment of the bar, which actually changes with the tolerance. The newly designed hook member of the present invention allows for the use of an adequate vertical sliding rail, and which can be used whether it is for a beam or a truss. Because of the construction of the new masonry connectors of the present invention, the new method of embedment assures that there will have no less than two or three embedment points, depending on the model used, even when used in a hollow block and with the varying depths of embedment. Thus the new system will allow the transfer of the shear forces efficiently, thereby promoting the use of the masonry wall as a shear wall, which in turn can lower the overall cost of the construction significantly.

9. The present invention allows for the connection of masonry walls to trusses, joists and joist girders. Thus, where previously it was necessary to place a beam or a girder along the wall, just to allow for a proper connection, now one can place a truss, joist, or joist girder. The result will allow savings in the amount of steel used in a project.

Therefore, although this invention has been described with a certain degree of particularity, it is to be understood that the present disclosure has been made only by way of illustration and that numerous changes in the details of construction and arrangement of parts may be resorted to without departing from the spirit and scope of the invention.

I claim:

1. A system for connecting a block wall to a building frame comprising:

a building frame having a generally vertically oriented rail;

a block wall spaced apart from the building frame wherein the block wall has a plurality of horizontal mortar joints;

a masonry connector comprising an elongate plate having an embedment end embedded in at least one of the horizontal mortar joints and a non-embedded hook end for hooking to the rail wherein the hook end is a slitted end of the plate, the slit opening up into a notch sized larger than the slit, the notch accommodating the rail wherein the notch is sized roughly equally to the cross sectional size of the rail to substantially enclose the rail generally on all sides thereof, the slit dividing the hook end into first and second tabs disposed on opposite sides of the notch wherein the tabs are bent apart in opposite directions, bent away from the plane of the plate.

2. The system of claim 1, wherein the building frame comprises metal.

3. The system of claim 1, wherein the building frame comprises concrete.

4. The system of claim 1, wherein the tabs are readily bendable about a bend region.

5. The system of claim 4, wherein the tabs are resiliently spring-like.

6. The system of claim 1, wherein the masonry connector comprises first and second elongate plate members and wherein the second elongate plate member is transverse to the first plate member.

7. The system of claim 6, wherein the first plate member is pivotable with respect to the second plate member.

8. The system of claim 6, wherein the first plate member is rigidly secured to the second plate member.

9. The system of claim 1, in combination with a hollow block wherein the masonry connector is generally T-shaped and a cross bar of the masonry connector extends across at least one rib of the hollow block.

10. The system of claim 1, in combination with a hollow block wherein the masonry connector is generally L-shaped and a cross bar of the masonry connector extends across at least one rib of the hollow block.

11. A system for connecting a block wall to a building frame comprising:.

a building frame having a generally vertically oriented rail;

a block wall spaced apart from the building frame wherein the block wall has a plurality of horizontal mortar joints;

a masonry connector comprising an elongate plate having an embedment portion embedded in at least one of the horizontal mortar joints and a non-embedded hook portion for connecting to the rail wherein the hook portion includes opposed and overlapping tabs extending from a main body of the plate, the tabs defining a notch therebetween that accommodates the rail, the notch sized roughly equally to the cross sectional size of the rail.

12. The system of claim 11, wherein the masonry connector comprises first and second elongate plate members and wherein the second elongate plate member is transverse to the first plate member and wherein the first plate member is pivotable with respect the second plate member.

13. The system of claim 12, in combination with a hollow block wherein the masonry connector is generally T-shaped and a cross bar of the masonry connector extends across at least one rib of the hollow block.

14. The system of claim 12, in combination with a hollow block wherein the masonry connector is generally L-shaped and a cross bar of the masonry connector extends across at least one rib of the hollow block.

15. The system of claim 11, wherein the tabs are bent apart in opposite directions from a longitudinal axis of the elongate plate.

16. A method of anchoring a wall having a plurality of horizontal mortar joints to a building support structure having a substantially vertically oriented rail, the method comprising the steps of:

selecting a masonry connector comprising an elongate plate having an embedment end for embedment in at least one of the horizontal mortar joints and a hook end for connecting to the rail wherein, the hook end includes first and second tabs bent apart in opposite directions, bent away from the plane of the plate, the tabs defining a notch therebetween the notch sized roughly equally to the cross sectional size of the rail;

positioning the rail within the notch between the tabs;

rotating the elongate plate to hook the rail within the notch; and embedding the embedment end in the at least one mortar joint.

17. The method of claim 16, wherein the tabs are overlapping.

18. The method of claim 16, wherein the hook end is a slitted end of the plate.

* * * * *